US007565774B2

(12) United States Patent
Shizuku et al.

(10) Patent No.: US 7,565,774 B2
(45) Date of Patent: Jul. 28, 2009

(54) SEISMIC ISOLATION APPARATUS

(75) Inventors: Takahisa Shizuku, Kodaira (JP); Masami Kikuchi, Kodaira (JP); Katsuhiro Kobayashi, Kodaira (JP); Yoshikatsu Sakai, Kodaira (JP); Wataru Seki, Kodaira (JP); Takashi Yokoi, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 505 days.

(21) Appl. No.: 11/294,438

(22) Filed: Dec. 6, 2005

(65) Prior Publication Data

US 2006/0137264 A1 Jun. 29, 2006

(30) Foreign Application Priority Data

Dec. 7, 2004 (JP) ..... 2004-353888
Jan. 25, 2005 (JP) ..... 2005-016865
May 25, 2005 (JP) ..... 2005-151982

(51) Int. Cl.
*E04H 9/00* (2006.01)
*E04B 1/98* (2006.01)
*F16M 13/00* (2006.01)

(52) U.S. Cl. ..... 52/167.1; 52/167.4; 52/1; 248/565

(58) Field of Classification Search ..... 52/1, 52/167.1, 167.4–167.9, 573.1; 248/565, 248/621

See application file for complete search history.

(56) References Cited

U.S. PATENT DOCUMENTS 1,936,389 A * 11/1933 Hallquist ..... 267/292
2,631,841 A * 3/1953 Tillou et al. ..... 267/134
4,713,917 A * 12/1987 Buckle et al. ..... 52/167.1
4,899,323 A * 2/1990 Fukahori et al. ..... 367/176
4,933,238 A * 6/1990 Fukahori et al. ..... 428/495
5,233,800 A * 8/1993 Sasaki et al. ..... 52/167.1
5,373,670 A * 12/1994 Sasaki et al. ..... 52/167.7
5,884,440 A * 3/1999 Kubo et al. ..... 52/167.1
2007/0085251 A1* 4/2007 Kikuchi et al. ..... 267/152

FOREIGN PATENT DOCUMENTS

EP 287683 A1 * 10/1988
EP 411876 A1 * 2/1991
JP 62155344 A * 7/1987
JP 11-270621 A 10/1999

OTHER PUBLICATIONS

Koji Kawahara et al. "Practical Examples in Various Fields of Damping Alloy", M2052 v.4.2, Jul. 2001.

* cited by examiner

*Primary Examiner*—Richard E Chilcot, Jr.
*Assistant Examiner*—Elizabeth A Plummer
(74) *Attorney, Agent, or Firm*—Sughrue Mion, PLLC

(57) ABSTRACT

A seismic isolation apparatus features damping characteristics equivalent to or better than prior art, without burdening the environment. In this seismic isolation apparatus, a cylindrical cavity portion is formed at the middle of an outer side laminated body, which has a form in which respective pluralities of resiliently deformable rubber rings and metal rings for maintaining rigidity are alternately laminated. A helically formed coil spring is disposed in this cavity portion so as to be snugly fitted. An inner side laminated body, which has a form in which respective pluralities of resiliently deformable rubber plates and metal plates for maintaining rigidity are alternately laminated, is disposed at an inner peripheral side of the coil spring.

6 Claims, 20 Drawing Sheets

DEFORMATION

DEFORMATION

SEISMIC ISOLATION APPARATUS

CROSS-REFERENCE TO RELATED APPLICATION

This application claims priority under 35 USC 119 from Japanese Patent Application Nos. 2004-353888, 2005-016865 and 2005-151982, the disclosure of which is incorporated by reference herein.

BACKGROUND OF THE INVENTION

1. Technical Field

The present invention relates to a seismic isolation apparatus which does not burden the environment and which features damping characteristics better than prior art.

2. Description of the Related Art

Heretofore, seismic isolation apparatuses which are disposed between buildings and ground that supports the buildings, for reducing shaking due to earthquakes, have been known. In such a seismic isolation apparatus, in addition to a rubber body which serves as a resilient body, a damping alloy for mitigating vibrations associated with the shaking is incorporated. By compound action of these members, shaking due to earthquakes is mitigated, and earthquake shaking is less likely to be propagated to the building.

However, a lead material is commonly employed as the damping alloy of a conventional seismic isolation apparatus, in consideration of damping characteristics thereof. With concern for environmental aspects having become an important consideration in recent years, substitution of lead materials with other materials is being investigated.

Accordingly, a seismic isolation apparatus in which, in place of a damping alloy formed of a lead material, for example, a twin crystal alloy is processed into the form of a coil spring and incorporated in a rubber member has been considered. However, with a seismic isolation apparatus which simply employs a coil spring of a twin crystal alloy, when a horizontal direction displacement is applied to the seismic isolation apparatus, on the first occasion of displacement, an internal coil spring 122 is twisted in vicinities of two end portions thereof, as shown in FIG. 5B, and is crushed along a direction of a displacement X. As a result, it is not possible to maintain stable damping capabilities, and satisfactory damping effects are not obtained.

Accordingly, a seismic isolation apparatus with a structure in which a resin material fills the inside of a coil spring so as to obtain satisfactory damping effects, and the seismic isolation apparatus of Japanese Patent Application Laid-Open (JP-A) No. 11-270621 (JPA '621) and suchlike have been considered. The seismic isolation apparatus of JPA '621 has structure in which, instead of a damping alloy formed of a lead material, an ordinary coil spring in which, for example, a cross-sectional shape of a wire material thereof is formed to be circular, is inserted into a rubber laminate so as to provide satisfactory damping effects, and attenuation forces are generated.

Hence, a necessity has arisen to develop a component that does not burden the environment and that has damping characteristics equivalent to or better than conventional damping alloys, to serve as a damping alloy to be employed in seismic isolation apparatuses. However, with a seismic isolation apparatus in which a resin material fills the inside of a coil spring, or the seismic isolation apparatus of JPA '621 or the like, the coil spring that is used instead of a damping alloy is not capable of properly following displacements. Therefore, in accordance with crushing of the coil spring that is caused by rotation forces within the rubber body, there is an effect that generated forces are large, particularly at displacement limit points, and satisfactory damping characteristics have not been obtained after all.

Further, a necessity has arisen to develop a component that does not burden the environment and that has damping characteristics equivalent to or better than conventional damping alloys, to serve as a damping alloy to be employed in seismic isolation apparatuses. However, with the seismic isolation apparatus of JPA '621, in which an ordinary coil is employed with the cross-sectional shape of the wire material being a circular form, attenuation amounts of required magnitudes are not sufficiently obtained.

Accordingly, making a wire diameter, which is a diameter of the wire material of the coil spring, larger in order to increase attenuation amounts has been considered. However, if the wire diameter is simply made larger, stiffness increases and is excessive, and there is a risk of breaking laminated sheets which are disposed at an outer peripheral side of the coil spring to serve as the structural component of laminated rubber.

When an ordinary coil spring is employed, the coil spring deforms in accordance with the application of horizontal direction displacements to the seismic isolation apparatus. However, on the occasion of, for example, a first large displacement, there has been a risk of rotation forces being generated within the rubber laminate and the coil spring being crushed. Thus, when the coil spring in the seismic isolation apparatus has been crushed and has collapsed because of a large displacement, attenuation forces that are generated by the seismic isolation apparatus are reduced. Hence, it is not possible to maintain stable damping capabilities, and satisfactory damping effects are not obtained.

SUMMARY OF THE INVENTION

In consideration of the circumstances described above, a seismic isolation apparatus which does not burden the environment and which features damping characteristics equivalent to or better than prior art has been devised.

A seismic isolation apparatus relating to a first aspect of the present invention includes: an outer side laminated body with a form in which first resilient plates and first stiff plates are alternately laminated, the first resilient plates being formed in ring shapes and the first stiff plates being formed in ring shapes; a coil spring fabricated of metal, which is disposed inside the outer side laminated body; and an inner side laminated body, with a form in which second resilient plates and second stiff plates are alternately laminated, the second resilient plates being formed in disc shapes and the second stiff plates being formed in disc shapes, and the inner side laminated body being disposed at an inner peripheral side of the coil spring.

Operation of the seismic isolation apparatus relating to the first aspect of the present invention will be described. According to the seismic isolation apparatus of this aspect, structure is formed in which the coil spring made of metal is disposed inside the outer side laminated body with the form in which the first resilient plates, which feature resilience and are formed in a ring shape, and the first stiff plates, which feature stiffness and are formed in the ring shape, are alternatingly laminated. Further, structure is formed in which the inner side laminated body with the form in which the second resilient plates, which feature resilience and are formed in a disc shape, and the second stiff plates, which feature stiffness and are formed in the disc shape, are alternatingly laminated is disposed at the inner peripheral side of the coil spring.

Thus, in the apparatus of the first aspect of the present invention, the coil spring is employed so as to reliably deform to match inputs of displacement, and the coil spring and the inner side laminated body are incorporated in a form in which the inner side laminated body, which serves as a support material at the inner side of the coil spring, is substituted for a damping alloy. Accordingly, when a displacement is inputted to the seismic isolation apparatus, the inner side laminated body restricts deformation of the coil spring. Therefore, the coil spring will not be crushed even when large horizontal direction displacements are applied, stable damping capabilities will be exhibited even after repeated displacements, and damping characteristics can be stably preserved.

Hence, according to the seismic isolation apparatus relating to the first aspect of the present invention, when an earthquake occurs, earthquake shaking is mitigated by compound action of the outer side laminated body, which is a rubber body which is disposed in parallel with the coil spring and resiliently deforms, with the coil spring. Thus, the earthquake shaking is less likely to be propagated to a building. Further, in the seismic isolation apparatus of the present aspect, because the inner side laminated body formed by laminating the second stiff plates and the second resilient plates is disposed at the inner peripheral side of the coil spring, the damping characteristics described above are obtained even without employing a lead material. Therefore, a burden thereof on the environment is eliminated.

Thus, because the inner side laminated body serving as a support material is disposed at the inner side of the coil spring, the seismic isolation apparatus relating to the first aspect of the present invention is provided with damping characteristics equivalent to or better than a conventional seismic isolation apparatus, without imposing a burden on the environment.

A seismic isolation apparatus relating to a second aspect of the present invention includes: an outer side laminated body with a form in which outer side resilient plates and outer side stiff plates are alternately laminated, the outer side resilient plates being formed in ring shapes and the outer side stiff plates being formed in ring shapes; and a coil spring fabricated of metal, which is disposed inside the outer side laminated body, a cross-sectional shape of a wire material of the coil spring being a quadrilateral form.

Operation of the seismic isolation apparatus relating to the second aspect of the present invention will be described. According to the seismic isolation apparatus of this aspect, structure is formed in which the coil spring made of metal, with the cross-sectional shape of the wire material being a quadrilateral, is disposed inside the outer side laminated body with the form in which the outer side resilient plates, which feature resilience and are formed in a ring shape, and the outer side stiff plates, which feature stiffness and are formed in the ring shape, are alternatingly laminated.

Thus, in the apparatus of the present aspect, when a horizontal direction displacement is inputted to the seismic isolation apparatus, the coil spring made of metal whose wire material cross-sectional shape is the quadrilateral deforms to match the input of displacement. However, neighboring faces of the wire material whose cross-sectional shape is the quadrilateral touch one another at this time. Thus, the wire material limitingly abuts together and a collapse of the coil spring can be automatically prevented.

Consequently, the coil spring will not be crushed even when large horizontal direction displacements are applied to the seismic isolation apparatus. Therefore, stable damping capabilities are exhibited even after repeated displacements, and damping characteristics can be stably preserved. Hence, according to the seismic isolation apparatus relating to the present aspect, when an earthquake occurs, earthquake shaking is reliably mitigated by compound action of the outer side laminated body, which is disposed in parallel with the coil spring and resiliently deforms, with the coil spring. Therefore, the earthquake shaking is less likely to be propagated to a building.

Thus, because the coil spring whose wire material cross-sectional shape is a quadrilateral is disposed inside the outer side laminated body, the seismic isolation apparatus relating to the second aspect of the present invention provides the damping characteristics described above even without employing a lead material. Therefore, the seismic isolation apparatus is provided with damping characteristics equivalent to or better than a conventional seismic isolation apparatus, without imposing a burden on the environment.

A seismic isolation apparatus relating to a third aspect of the present invention includes: an outer side laminated body with a form in which outer side resilient plates and outer side stiff plates are alternately laminated, the outer side resilient plates being formed in ring shapes and the outer side stiff plates being formed in ring shapes; a plurality of coil springs fabricated of metal, which are disposed inside the outer side laminated body, cross-sectional shapes of wire materials of the coil springs being quadrilaterals, and external diameters of the coil springs being mutually different; and an influx material which is influxed to inside the outer side laminated body and is capable of restricting movement of the coil springs.

Operation of the seismic isolation apparatus relating to the third aspect of the present invention will be described.

According to the seismic isolation apparatus of this aspect, the outer side laminated body is included, in which the outer side resilient plates, which feature resilience and are formed in a ring shape, and the outer side stiff plates, which feature stiffness and are formed in the ring shape, are alternatingly laminated. Further, structure is formed in which the coil springs with mutually differing outer diameters, which are made of metal with respective cross-sectional shapes of wire members being quadrilaterals, are plurally disposed inside the outer side laminated body, and the influx material, which is capable of restricting movements of these coil springs, has been flowed in to inside the outer side laminated body.

Thus, in the apparatus of the third aspect of the present invention, when a horizontal direction displacement is inputted to the seismic isolation apparatus, the plurality of coil springs with mutually differing outer diameters, which are made of metal with wire material cross-sectional shapes thereof being quadrilaterals, respectively deform to match the input of displacement. However, neighboring faces of the wire materials whose cross-sectional shapes are quadrilaterals touch one another at this time. Thus, the wire materials limitingly abut together. Moreover, the influx material which has been influxed into the outer side laminated body adheres to each of the inner peripheral face of the outer side laminated body and the plurality of coil springs, and this influx material restricts movements of the coil springs to forms in line with the deformation of the outer side laminated body. Therefore, in addition to the wire materials of the coil springs limitingly abutting together, the influx material restricts movements of the coil springs. Thus, a collapse of the coil spring can be automatically prevented.

Consequently, crushing of the coil spring when large horizontal direction displacements are applied to the seismic isolation apparatus is reliably prevented. Therefore, stable damping capabilities are exhibited even after repeated displacements, and damping characteristics can be stably preserved. Hence, according to the seismic isolation apparatus relating to the present aspect, when an earthquake occurs, earthquake shaking is reliably mitigated by, in addition to compound action of the coil springs with the outer side laminated body, which are disposed in parallel with one another and respectively resiliently deform, further compound action of the same with the influx material. Therefore, the earthquake shaking is less likely to be propagated to a building.

Thus, because the coil springs with mutually differing outer diameters, which are made of metal with the wire material cross-sectional shapes being quadrilaterals, are plurally disposed inside the outer side laminated body and the influx material capable of restricting movement of the coil springs has been influxed into the outer side laminated body, the seismic isolation apparatus relating to the third aspect of the present invention provides the damping characteristics described above even without employing a lead material. Therefore, the seismic isolation apparatus is provided with damping characteristics equivalent to or better than a conventional seismic isolation apparatus, without imposing a burden on the environment.

DETAILED DESCRIPTION OF THE INVENTION

Figure 1:
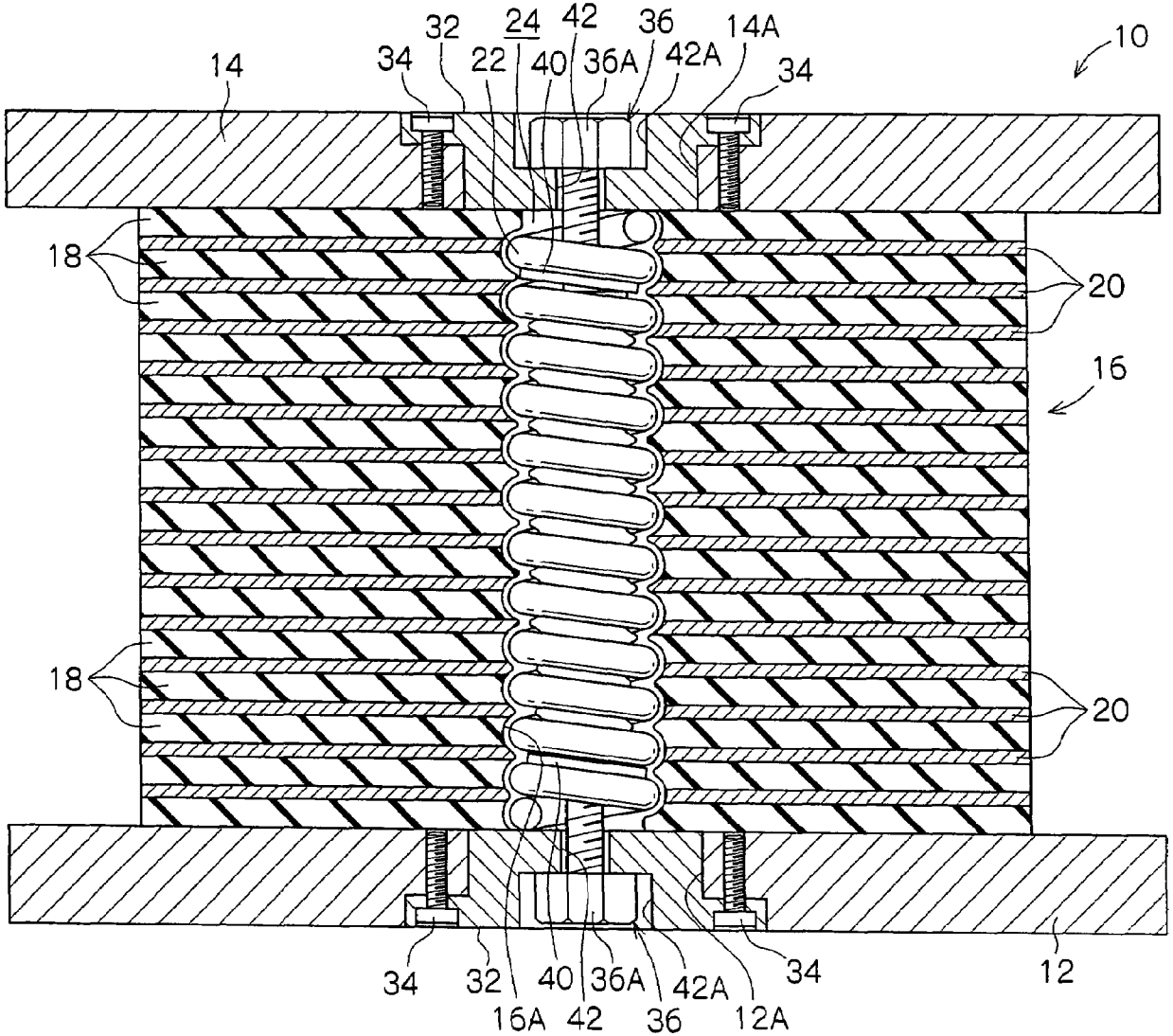
FIG. 1 is a sectional view of a seismic isolation apparatus relating to a first embodiment of the present invention.
Figure 2:
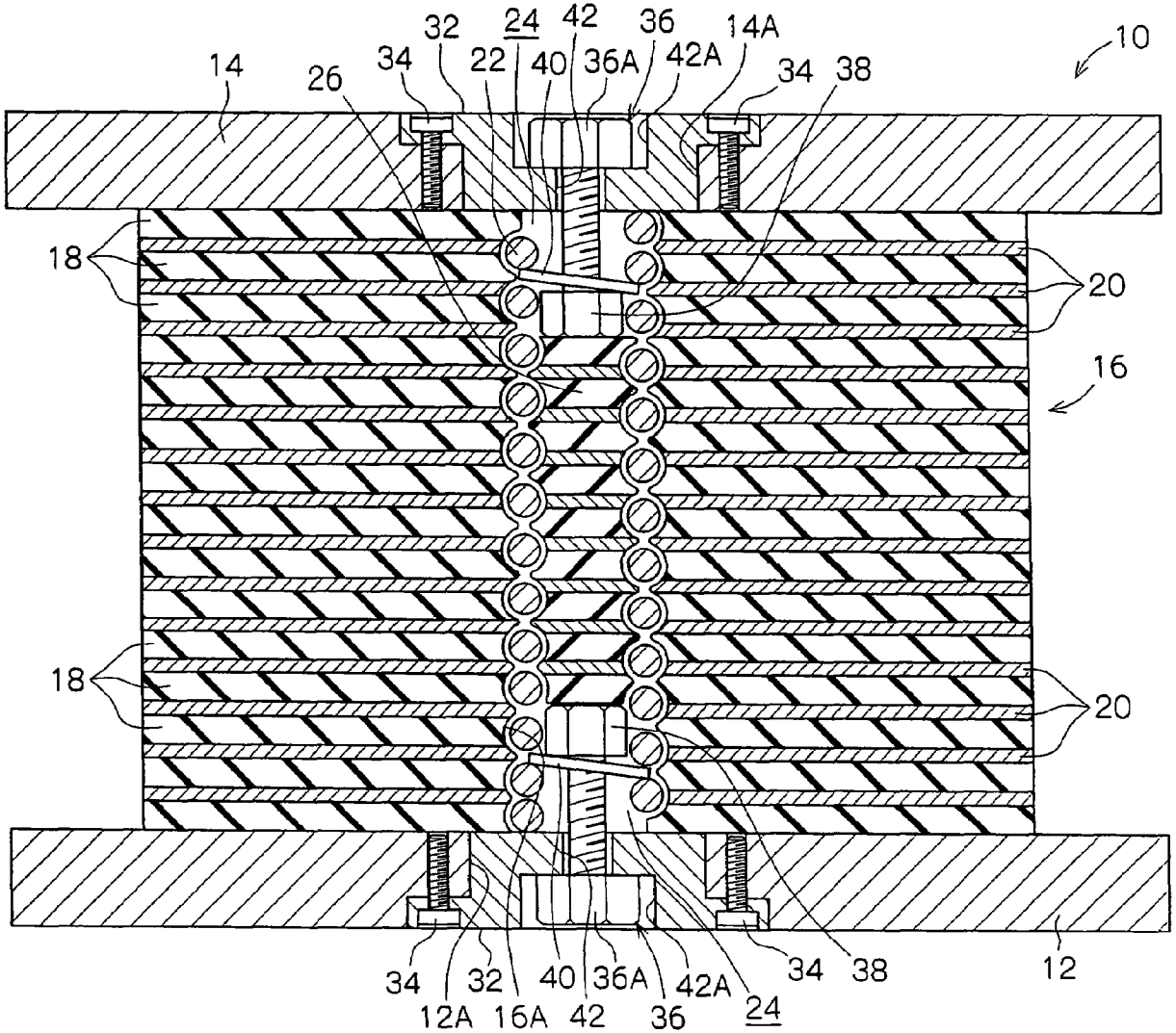
FIG. 2 is a sectional view of the seismic isolation apparatus relating to the first embodiment of the present invention, being a view which is cut across a coil spring.

Embodiments of a seismic isolation apparatus relating to the present invention will be described on the basis of FIGS. 1 to 9B. As shown in FIGS. 1 and 2, top and bottom portions of a seismic isolation apparatus 10 relating to a first embodiment of the present invention are structured by connection plates 12 and 14, each of which is formed in a circular plate shape. In this structure, the lower of these, the connection plate 12, abuts against the ground and the upper connection plate 14 abuts against a lower portion of a building.

An outer side laminated body 16 is disposed between this pair of connection plates 12 and 14. The outer side laminated body 16 is formed in a tubular shape including a tubular cavity portion 24 at a central portion thereof. The outer side laminated body 16 is structured in a form in which a rubber ring 18 fabricated of rubber and a metal ring 20 fabricated of metal are plurally alternatingly disposed. The rubber ring 18 is a first resilient plate, which is formed in a ring shape and is capable of resilient deformation. The metal ring 20 is a first stiff plate for maintaining rigidity, which is formed in a ring shape.

These two connection plates 12 and 14 are respectively adhered by vulcanization to be attached to upper and lower ends, respectively, of the outer side laminated body 16. At centers of this pair of connection plates 12 and 14, circular through-holes 12A and 14A, each of which includes an intermediate step portion, are formed. Further, lid members 32 with sizes corresponding to the through-holes 12A and 14A, which include flanges at outer peripheral sides thereof, are screwed on by bolts 34. Thus, the lid members 32 are fixed to each of the pair of connection plates 12 and 14 to close off the respective through-holes 12A and 14A.

A coil spring 22 is disposed so as to fit snugly in the cylindrical cavity portion 24 formed in the middle of the outer side laminated body 16. The coil spring 22 is formed of a twin crystal metallic material, in the form of a helical coil spring which can be resiliently deformed. Further, at an inner peripheral face 16A of the outer side laminated body 16 in which the cavity portion 24 is formed, protrusions and indentations are formed in a helical shape along an outer peripheral side form of the coil spring 22 so as to correspond with the outer peripheral side form of the coil spring 22.

Figure 3:
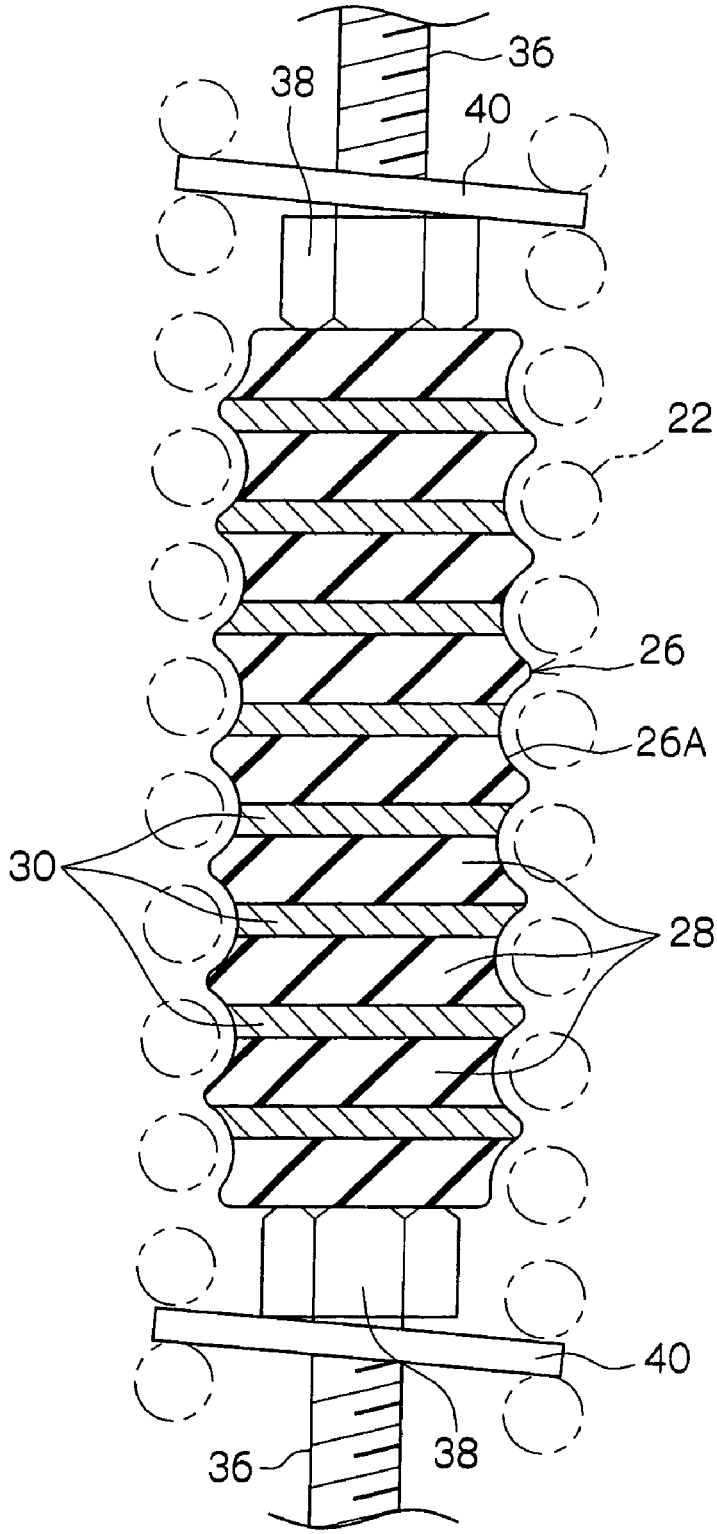
FIG. 3 is a sectional view showing an enlargement of an inner side laminated body of the seismic isolation apparatus relating to the first embodiment of the present invention.

As shown in FIGS. 2 and 3, an inner side laminated body 26, which is formed in a cylindrical shape, is disposed at an inner peripheral side of the coil spring 22. This inner side laminated body 26 is structured in a form in which a rubber plate 28 fabricated of rubber and a metal plate 30 fabricated of metal are plurally alternatingly disposed. The rubber plate 28 is a second resilient plate, which is formed in a disc shape and is capable of resilient deformation. The metal plate 30 is a second stiff plate for maintaining rigidity, which is formed in a disc shape. Further, at an outer peripheral face 26A of the inner side laminated body 26, protrusions and indentations are formed in a helical form corresponding with a helical shape of an inner peripheral side of the coil spring 22.

Thus, the present embodiment has a structure in which the outer side laminated body 16 and the inner side laminated body 26 which are capable of resilient deformation are disposed in parallel with the coil spring 22 which is helically formed of the twin crystal metallic material so as to be resiliently deformable. Furthermore, in this structure, the coil spring 22 is sandwiched by the inner side laminated body 26, the outer peripheral face 26A of which is formed in a shape corresponding to the shape of the coil spring 22, and the outer side laminated body 16, the inner peripheral face 16A of which is similarly formed in a shape corresponding to the shape of the coil spring 22.

Anyway, as shown in FIGS. 1 and 2, a respective through-hole 42 is formed at the middle of each of the pair of lid members 32, which are fixed to the lower connection plate 12 and the upper connection plate 14. Each through-hole 42 includes a seat portion 42A at an outer side thereof. A respective constriction bolt 36 passes through this through-hole 42 with a form in which a head portion 36A thereof is disposed in the seat portion 42A. A nut 38 is screwed on at a distal end portion of each constriction bolt 36, and a washer 40 is rested at the nut 38.

In a state in which the constriction bolt 36 is inserted at the inner peripheral side of the coil spring 22, a portion corresponding to a single winding of the coil spring 22, which serves as an end portion thereof, is sandwiched between the washer 40 and an opposing face of the lid member 32 that opposes the washer 40. Thus, the present embodiment has a structure in which the two end portions of the coil spring 22 are respectively fixed at two end portions of the outer side laminated body 16, via the connection plates 12 and 14 and the lid members 32, by the constriction bolts 36, the nuts 38 and the washers 40, which serve as fixing fixtures.

A height of the coil spring 22 in a free state is greater than a height of the outer side laminated body 16. Accordingly, in the state in which the coil spring 22 has been assembled into the outer side laminated body 16, this is a form in which the coil spring 22 is compressed by the lid members 32 and pre-straining is applied to this coil spring 22.

Next, production of the seismic isolation apparatus 10 relating to the present embodiment will be described below.

When this seismic isolation apparatus 10 is to be fabricated, first, the helical coil spring 22 is fabricated. For a Mn—Cu—Ni—Fe alloy, a temperature of around 850° C. is maintained for around 1 hour, after which slow cooling is performed by air-cooling. Further, for a Cu—Al—Mn—Co alloy, a temperature of around 900° C. is maintained for around 5 minutes, after which rapid cooling and re-heating are performed, and 200° C. is maintained for around 15 minutes, after which air-cooling is performed. Thus, it is possible to form the coil spring 22 of twin crystals.

Separately, the rubber rings 18 and the metal rings 20 are laminated to form the outer side laminated body 16. Thus, the outer side laminated body 16 is fabricated. In addition, the rubber plates 28 and the metal plates 30 are laminated to form the inner side laminated body 26. Thus, the inner side laminated body 26 is fabricated. Here, the pair of connection plates 12 and 14 are adhered by vulcanization and attached to the top and bottom, respectively, of the outer side laminated body 16.

Here, the outer side laminated body 16 is fabricated such that a height of the outer side laminated body 16 is less than a height of the coil spring 22, with the helical indentations and protrusions along the outer peripheral side shape of the coil spring 22 being preparatorily formed at the inner peripheral face 16A of the outer side laminated body 16, and the helical indentations and protrusions along the inner peripheral side shape of the coil spring 22 being preparatorily formed at the outer peripheral face 26A of the inner side laminated body 26.

Thereafter, the inner side laminated body 26 is inserted into the coil spring 22. Then, in a state in which the respective nuts 38 and washers 40 are disposed at the two end portions of the coil spring 22, the coil spring 22 and the inner side laminated body 26 are passed through, for example, the through-hole 12A of the connection plate 12 and inserted into the cavity portion 24 which is formed at the middle of the outer side laminated body 16. Then, the lid members 32 are respectively screwed on and attached to the connection plates 12 and 14, and the constriction bolts 36 are screwed into the nuts 38. Thus, the seismic isolation apparatus 10 is completed.

At this time, the coil spring 22 which has been formed to be higher than the height of the outer side laminated body 16 is compressed so as to be the same height as the outer side laminated body 16 in accordance with the lid members 32 being screwed to the connection plates 12 and 14. Thus, the coil spring 22 is compressed into a state in which pre-straining is applied thereto. Further, by the constriction bolts 36 being screwed in by required amounts, the end portions of the coil spring 22 are constricted, and are thus fixed at the lid members 32.

Next, operations of the seismic isolation apparatus 10 relating to the present embodiment will be described.

According to the seismic isolation apparatus 10 of the present embodiment, structure is formed in which the coil spring 22 which is formed of the twin crystal metallic material is disposed inside the outer side laminated body 16 with the form in which the metal rings 20 which include stiffness and are formed in the ring shape and the rubber rings 18 which include resilience and are formed in the ring shape are alternately laminated. Further, structure is formed in which the inner side laminated body 26, with the form in which the metal plates 30 which include stiffness and are formed in the disc shape and the rubber plates 28 which include resilience and are formed in the disc shape are alternately laminated, is disposed at the inner peripheral side of the coil spring 22. Further, at the inner peripheral face 16A of the outer side laminated body 16 and the outer peripheral face 26A of the inner side laminated body 26, the respective indentations and protrusions with forms corresponding to the shape of the coil spring 22 are formed as shown in FIGS. 2 and 3.

Figure 4:
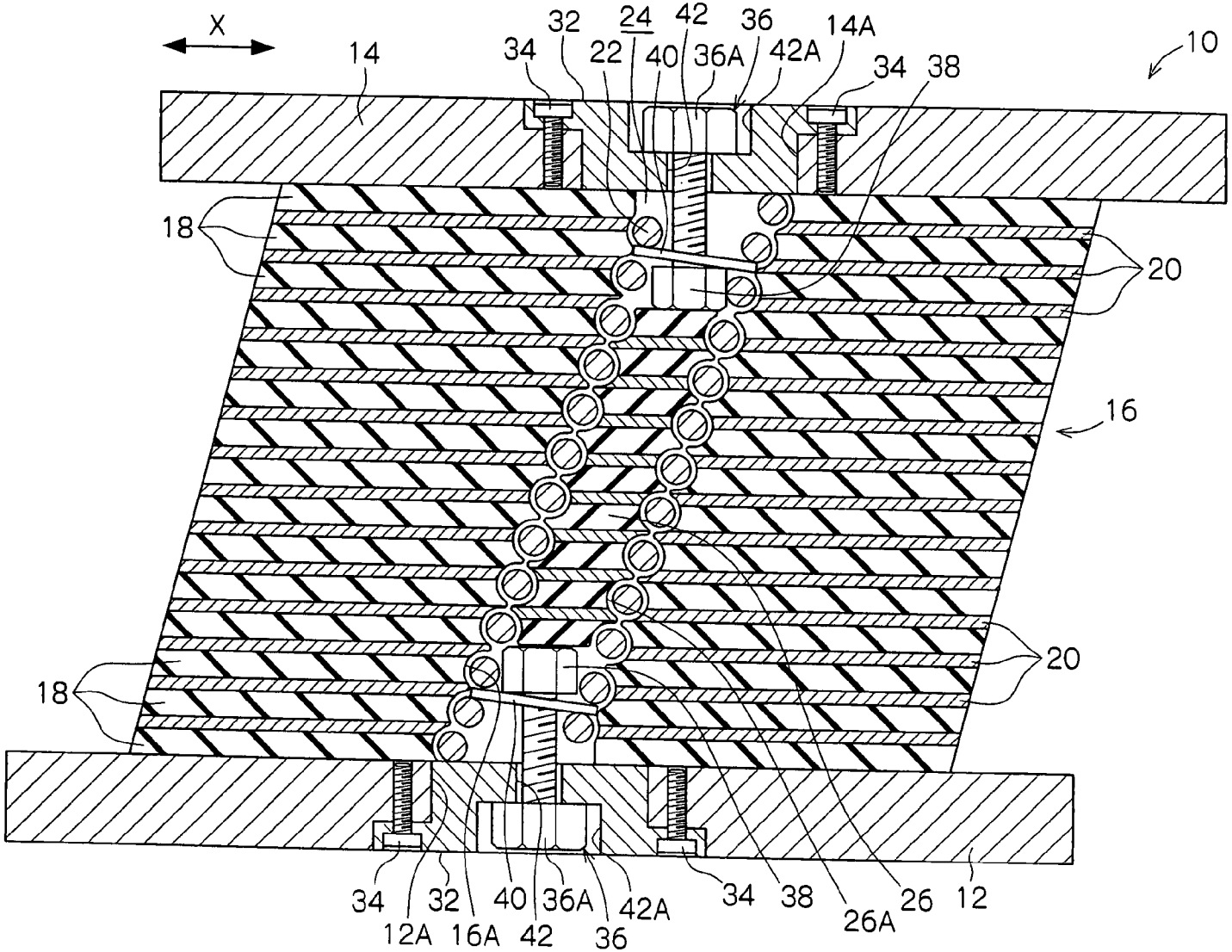
FIG. 4 is a sectional view of a state in which a horizontal direction displacement is applied to the seismic isolation apparatus relating to the first embodiment of the present invention.
Figure 5A:
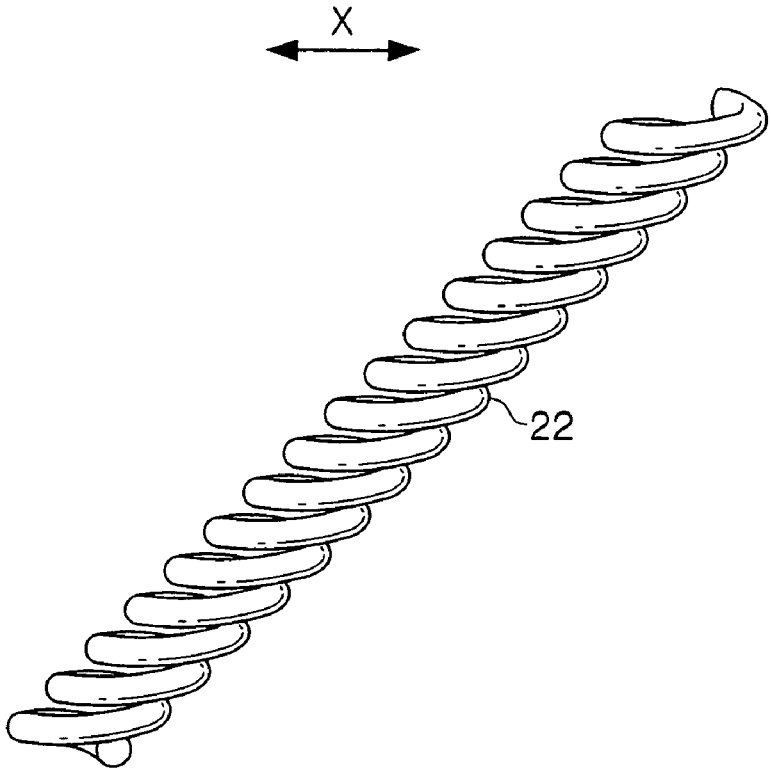
FIG. 5A is a view for explaining deformation of the coil spring of the seismic isolation apparatus relating to the first embodiment of the present invention in comparison with conventional technology.
Figure 5B:
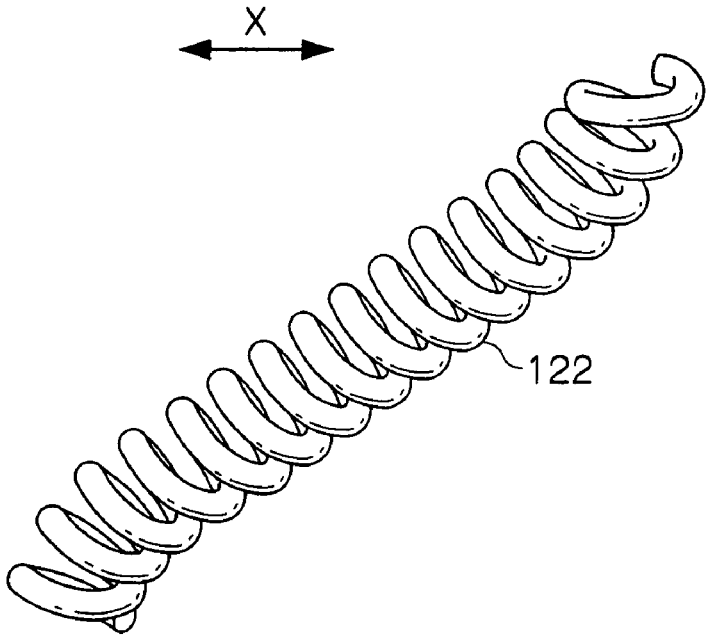
FIG.5B PRIOR ART
FIG. 5B shows a coil spring of conventional technology.

Thus, in the present embodiment, the coil spring 22 and the inner side laminated body 26 are incorporated, in the form wherein the coil spring 22 is employed so as to consistently deform to match inputs of deformations and the structure in which the inner side laminated body 26 serving as a support material is inserted at the inner side of the coil spring 22 replaces a damping alloy. Hence, the inner side laminated body 26 restricts deformation of the coil spring 22 when a displacement is inputted to the seismic isolation apparatus 10. Thus, as shown in FIGS. 4 and 5A, even when large horizontal direction displacements X are applied, the coil spring 22 will not be crushed, stable damping capabilities will be exhibited even after repeated displacements, and damping characteristics can be stably preserved.

Consequently, according to the seismic isolation apparatus 10 relating to the present embodiment, when an earthquake occurs, earthquake shaking is reliably mitigated by compound action of the outer side laminated body 16, which is disposed in parallel with the coil spring 22 and resiliently deforms, with the coil spring 22, and the earthquake shaking is less likely to be propagated to the building. Meanwhile, because the inner side laminated body 26 formed by laminating the metal plates 30 and the rubber plates 28 is disposed at the inner side of the coil spring 22, the seismic isolation apparatus 10 of the present embodiment provides the damping characteristics described above even without employing a lead material. Therefore, a burden thereof on the environment is eliminated.

Furthermore, because the inner side laminated body 26 serving as the support material is disposed inside the coil spring 22, the seismic isolation apparatus 10 relating to the present embodiment features damping capabilities equivalent to or better than a conventional seismic isolation apparatus 10 without imposing a burden on the environment.

Further, in the present embodiment, the inner peripheral face 16A of the outer side laminated body 16 and the outer peripheral face 26A of the inner side laminated body 26 are respectively formed into the shapes along the form of the coil spring 22. That is, it can be suggested that if the coil spring 22 were simply disposed inside the outer side laminated body 16 and the inner side laminated body 26 simply disposed inside the coil spring 22, sufficient restraint might not be provided by the inner peripheral face 16A of the outer side laminated body 16 and the outer peripheral face 26A of the inner side laminated body 26, the coil spring 22 would not properly deform, and a damping effect would be reduced.

In contrast, in accordance with the helical indentations and protrusions with forms corresponding to the shape of the coil spring 22 being formed at the inner peripheral face 16A of the outer side laminated body 16 and the outer peripheral face 26A of the inner side laminated body 26 as in the present embodiment, deformations of the coil spring 22 are corrected by wall faces of the inner peripheral face 16A and the outer peripheral face 26A, and are optimized. Thus, strain is effectively generated in the coil spring 22 without the coil spring 22 being crushed.

Further, in the present embodiment, the coil spring 22 is employed in place of a lead material, but if the coil spring 22 was simply inserted into the outer side laminated body 16, it can be suggested that, when a large displacement was applied to the seismic isolation apparatus 10, a large gap would be formed between an end face of the coil spring 22 and the lid member 32 opposing that end face, as a result of which the coil spring 22 would not be able to follow displacement of the seismic isolation apparatus 10 and hysteresis of a stress-strain curve would not be sufficiently large.

In contrast, according to the present embodiment, the fixing fixtures constituted by the constriction bolts 36, nuts 38 and washers 40 shown in FIG. 2 are employed at the two end portions of the outer side laminated body 16, and form a structure which fixes the two end portions of the coil spring 22. Consequently, the end portions of the coil spring 22 are mechanically limited and, as shown in FIGS. 4 and 5A, the coil spring 22 consistently follows displacements of the seismic isolation apparatus 10.

In the present embodiment, in accordance with the resiliently deformable, helical coil spring 22 being formed by the twin crystal metallic material, pre-straining is applied to the twin crystal metallic material structuring the coil spring 22. Hence, in comparison with a simple twin crystal alloy, when a tensile force, a shearing force or the like is applied, a spring constant is lower and an attenuation coefficient is higher. Thus, the present embodiment features large damping characteristics equivalent to or better than a conventional damping alloy.

Figure 6:
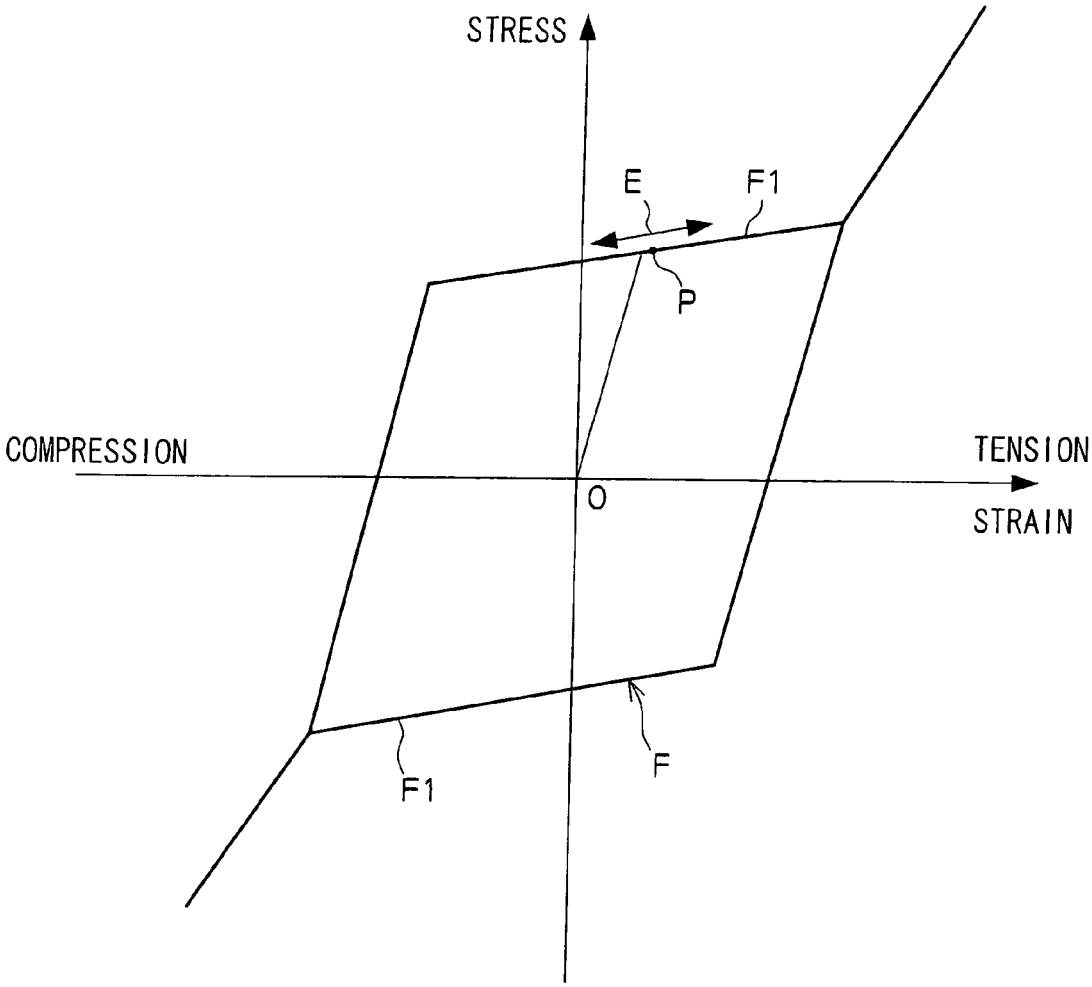
FIG. 6 is a view of a graph showing a stress-strain curve of the coil spring relating to the first embodiment of the present invention.

That is, when an external stress is applied to the coil spring 22, the pre-straining has been applied and the coil spring 22 has already been deformed to a point P in a region F1 of the stress-strain curve of FIG. 6 along which twin crystal deformation occurs. When the external stress is applied, the coil spring 22 is deformed as shown by arrow E in the region F1 along which twin crystal deformation occurs, in a form in which the twin crystal deformation is made even larger or a form in which the twin crystal deformation is made smaller.

Consequently, because the pre-straining has been applied to the twin-crystal coil spring 22, a reduction of the spring constant can be anticipated, and a range covered by a hysteresis curve F, which includes the region F1 of the stress-strain curve of FIG. 6, can be made larger. Thus, correspondingly effective and excellent damping characteristics are provided.

Figure 7:
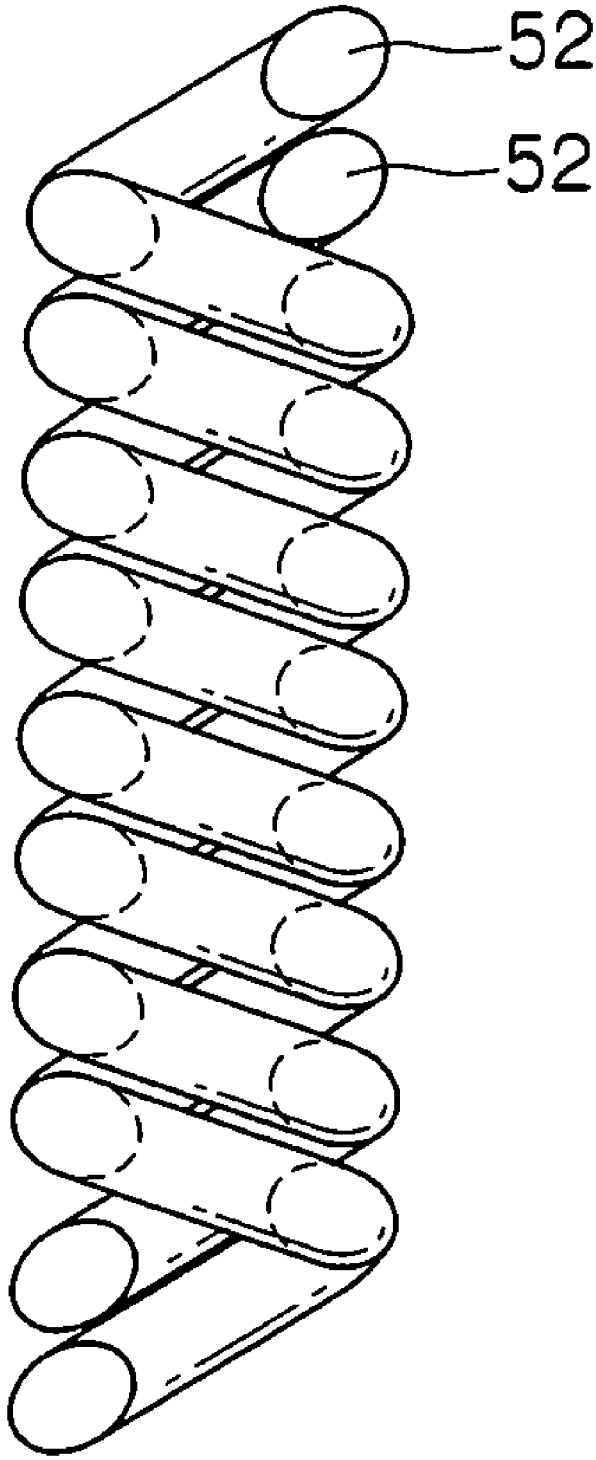
FIG. 7 is a front view of coil springs which are employed in a seismic isolation apparatus relating to a second embodiment of the present invention.

Next, a second embodiment of the seismic isolation apparatus relating to the present invention will be described on the basis of FIG. 7. Note that members that are the same as members described for the first embodiment are assigned the same reference numerals, and duplicative descriptions are omitted.

The seismic isolation apparatus 10 relating to the present embodiment is structured similarly to the first embodiment. However, there is a plurality (two in the present embodiment) of coil springs 52, with the same diameter. The plurality of coil springs 52 are coaxially combined as shown in FIG. 7 and are disposed in a dually superposed state inside the cavity portion 24 formed at the middle of the outer side laminated body 16.

Thus, because the plurality of coil springs 52 are coaxially combined and disposed, when a large horizontal direction displacement is applied to this seismic isolation apparatus 10, the individual coil springs 52 are less likely to be crushed. Therefore, after repeated displacements, even more stable damping capabilities will be exhibited and damping characteristics can be stably preserved.

Anyway, for the present embodiments, the use of, for example, any of the following twin crystal metallic materials can be considered: a Cu—Al—Mn alloy, a Mg—Zr alloy, a Mn—Cu alloy, a Mn—Cu—Ni—Fe alloy, a Cu—Al—Ni alloy, a Ti—Ni alloy, an Al—Zn alloy, a Cu—Zn—Al alloy, a Mg alloy, a Cu—Al—Co alloy, a Cu—Al—Mn—Ni alloy, a Cu—Al—Mn—Co alloy, a Cu—Si alloy, an Fe—Mn—Si alloy, an Fe—Ni—Co—Ti alloy, an Fe—Ni—C alloy, an Fe—Cr—Ni—Mn—Si—Co alloy, a Ni—Al alloy, and SUS304.

That is, when one of these metals is employed as the twin crystal metallic material for forming the coil spring 22, the coil spring 22 featuring damping characteristics equivalent to or better than prior art can be more assuredly provided without burdening the environment.

For example, if a manganese-based alloy such as a Mn—Cu alloy, a Mn—Cu—Ni—Fe alloy or the like is employed, the twin crystal metallic material is obtained by maintaining a temperature of 800° C. to 930° C. for a duration of around 0.5 to 2 hours, and slowly cooling over a duration of around 10 to 20 hours.

Further, if a copper-based alloy such as a Cu—Al—Mn alloy, a Cu—Al—Ni alloy, a Cu—Zn—Al alloy, a Cu—Al—Co alloy, a Cu—Al—Mn—Ni alloy, a Cu—Al—Mn—Co alloy, a Cu—Si alloy or the like is employed, the twin crystal metallic material is obtained by maintaining a temperature of about 900° C. for a duration of around 5 minutes to 1 hour, rapidly cooling, and then re-heating to a temperature of about 200° C. and maintaining this temperature for a duration of around 15 to 30 minutes.

Figure 8A:
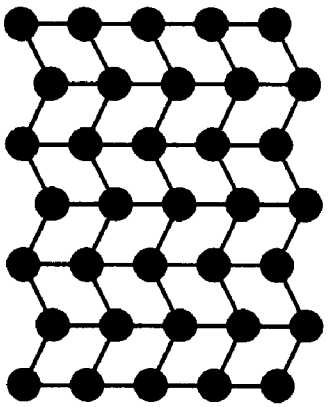
FIG. 8A is an explanatory view showing a molecular array in a coil spring relating to an embodiment of the present invention, which shows a martensitic phase.
Figure 8B:
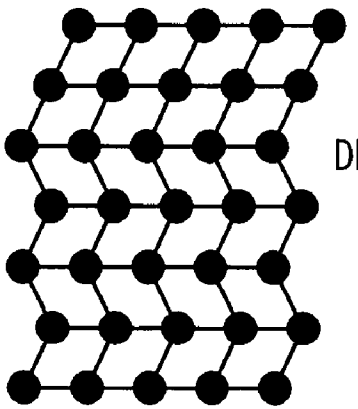
FIG. 8B is an explanatory view showing the molecular array in the coil spring relating to the embodiment of the present invention, which shows a state when a deformation of the martensitic phase has begun.
Figure 8C:
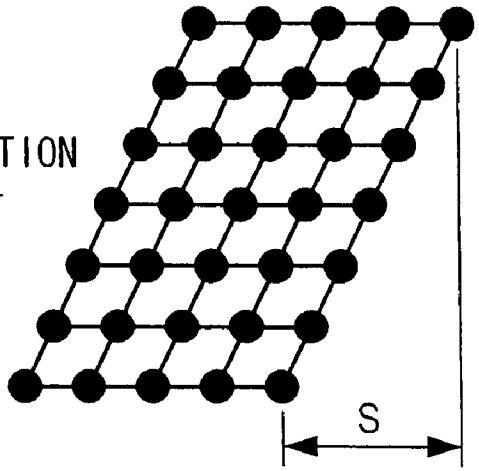
FIG. 8C is an explanatory view showing the molecular array in the coil spring relating to the embodiment of the present invention, which shows a state when the deformation of the martensitic phase has been completed.

Next, a mechanism of deformation of the coil spring 22 according to formation with twin crystals will be described. Stress is applied to a martensitic phase shown in FIG. 8A, in which metal molecules are evenly arrayed, from a lateral direction, and deformation commences as shown in FIG. 8B. Further, if the stress is further applied, deformation to the form shown in FIG. 8C is performed. In the state shown in FIG. 8C, a deformation amount with a dimension S has occurred.

Figure 9A:
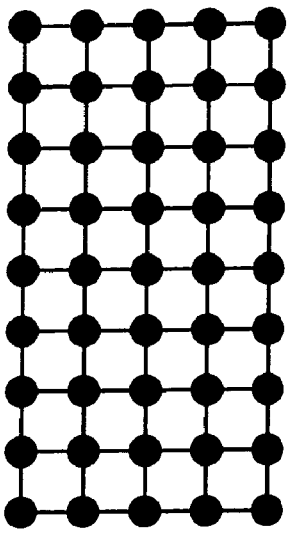
FIG. 9A is an explanatory view showing a molecular array in an ordinary metal, which shows a state in which the molecules are uniformly aligned.
Figure 9B:
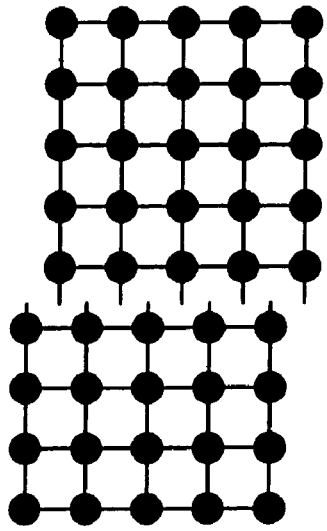
FIG. 9B is an explanatory view showing the molecular array in the ordinary metal, which shows a state in which a misalignment of a portion of the array of molecules has occurred.

In contrast, although molecules of an ordinary metal shown in FIG. 9A are uniformly arrayed, when stress is applied from a lateral direction, a misalignment arises in the array of molecules as shown in FIG. 9B, and a defect occurs. That is, when there is a misalignment in an array of molecules of an ordinary metal, plastic deformation results. Thus, once the state shown in FIG. 9B arises, there will be no return to the state shown in FIG. 9A.

Furthermore, differently from an ordinary metal, with a twin crystal metallic material, although deformation begins from a comparatively small stress, there will be no plastic deformation even with a deformation as far as the state shown in FIG. 8C. Thus, when the stress is reversed, the material will return to the state shown in FIG. 8A. Moreover, a cross-sectional area of the twin crystal metallic material is made smaller and deformation occurs from a stage at which stress applied to the whole body is low. Therefore, a spring constant of hysteresis of a stress-strain curve for the whole body will not rise.

Note that although the number of coil springs in the second embodiment described above is set to two, there may be three or more coil springs. Furthermore, in the embodiments described above, a twin crystal metallic material is employed as the material of the coil spring(s). However, a different, ordinary metallic material could be employed as the spring material.

Figure 10:
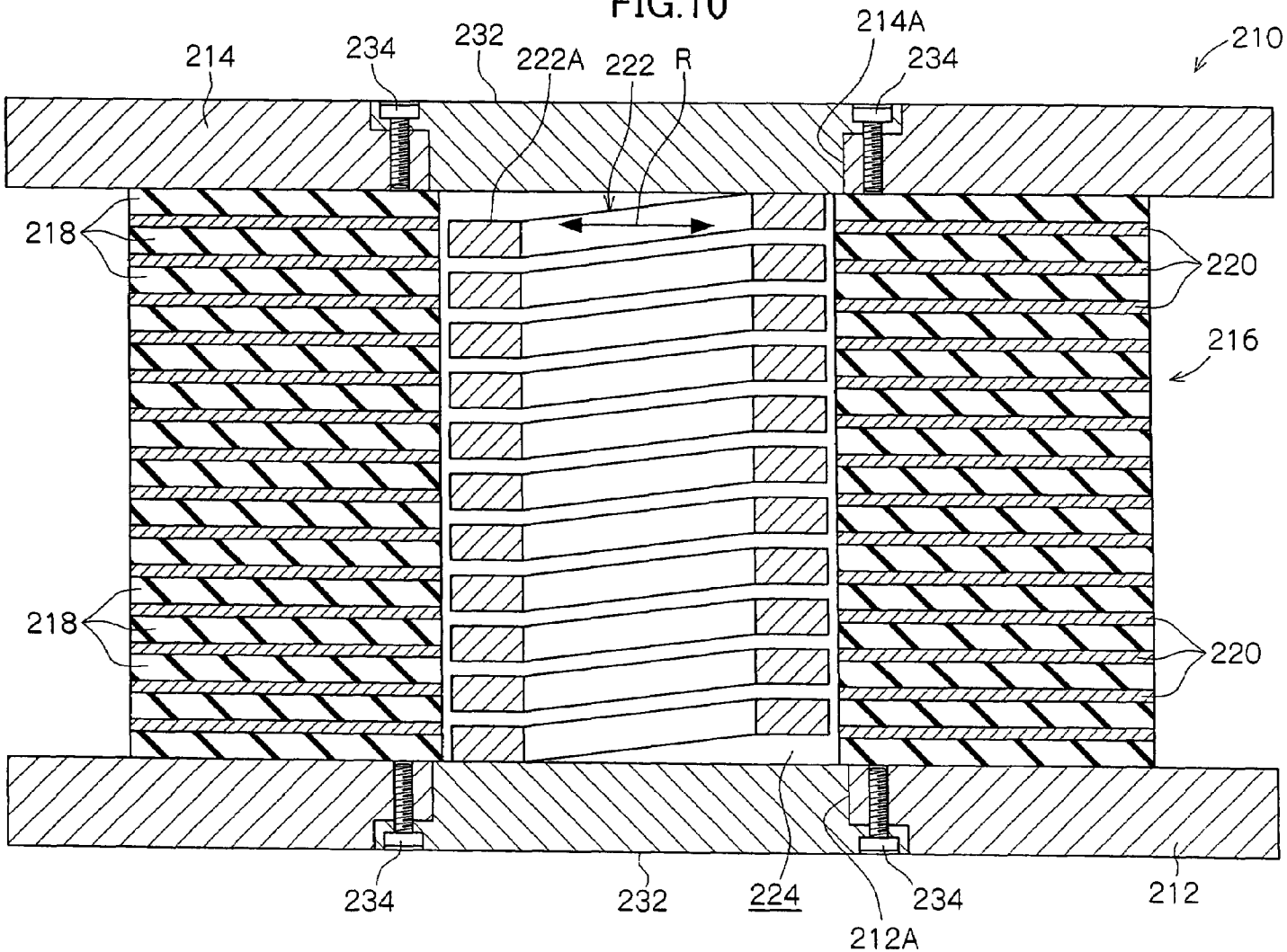
FIG. 10 is a sectional view of a seismic isolation apparatus relating to a third embodiment of the present invention.

A third embodiment of the seismic isolation apparatus relating to the present invention will be described on the basis of FIGS. 10 to 12. As shown in FIG. 10, top and bottom portions of a seismic isolation apparatus 210 relating to the third embodiment of the present invention are structured by connection plates 212 and 214, which are each formed in a circular plate shape. In this structure, the lower of these, the connection plate 212, abuts against the ground and the upper connection plate 214 abuts against a lower portion of a building.

An outer side laminated body 216 is disposed between this pair of connection plates 212 and 214. The outer side laminated body 216 is formed in a tubular shape including a tubular cavity portion 224 at a central portion thereof. The outer side laminated body 216 is structured in a form in which a rubber ring 218 fabricated of rubber and a metal ring 220 fabricated of metal are plurally alternatingly disposed. The rubber ring 218 is an outer side resilient plate, which is formed in a ring shape and is capable of resilient deformation. The metal ring 220 is an outer side stiff plate for maintaining rigidity, which is formed in a ring shape.

These two connection plates 212 and 214 are respectively adhered by vulcanization to be attached to upper and lower ends, respectively, of the outer side laminated body 216. At centers of this pair of connection plates 212 and 214, circular through-holes 212A and 214A, each of which includes an intermediate step portion, are formed. Further, lid members 232 with sizes corresponding to the through-holes 212A and 214A, which include flanges at outer peripheral sides thereof, are screwed on by bolts 234. Thus, the lid members 232 are fixed to each of the pair of connection plates 212 and 214 to close off the respective through-holes 212A and 214A.

A coil spring 222 is disposed so as to fit snugly in the cylindrical cavity portion 224 formed in the middle of the outer side laminated body 216. The coil spring 222 is formed of a wire material 222A of a twin crystal metallic material, a cross-sectional shape of which has a rectangular form, in the form of a resiliently deformable, helical coil spring. That is, the cross-sectional shape of the wire material 222A that structures the coil spring 222 is formed as a rectangle with long sides of this quadrilateral form in a radial direction R of the coil spring 222. Herein, the Young's modulus of this wire material 222A is, for example, around 47 GPa.

Further, the seismic isolation apparatus 210 relating to the present embodiment has a structure in which the outer side laminated body 216 which is capable of resilient deformation is disposed in parallel with the coil spring 222 which is helically formed of the twin crystal metallic material so as to be resiliently deformable. Further, a height of the coil spring 222 in a free state is greater than a height of the outer side laminated body 216. Accordingly, in the state shown in FIG. 10 in which the coil spring 222 has been assembled into the outer side laminated body 216, this is a form in which the coil spring 222 is compressed by the lid members 232 and pre-straining is applied to this coil spring 222.

Figure 11:
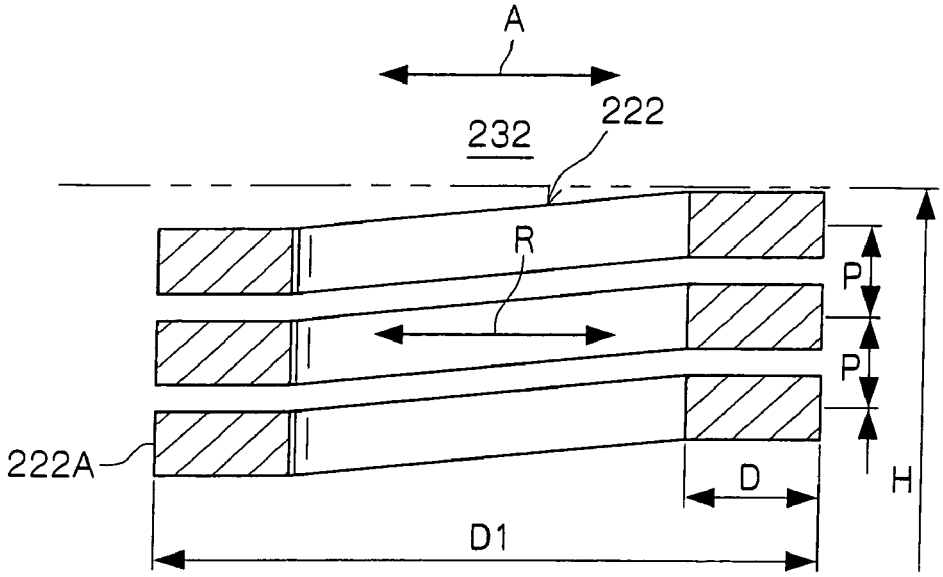
FIG. 11 is an enlarged view of principal elements, showing an enlargement of principal elements of a coil spring of the seismic isolation apparatus relating to the third embodiment of the present invention.

Now, if, as shown in FIG. 11, a height of the coil spring 222 in the state in which the coil spring 222 has been assembled to the seismic isolation apparatus 210 is H, an expected maximum displacement amount in a horizontal direction A of the coil spring 222 is X, a pitch of the wire material 222A structuring the coil spring 222 is P, and a cross-sectional width dimension of the wire material 222A is D, then it is necessary that the relationship $(X \times P/H) < (D/2)$ is satisfied.

That is, with the value $X \times P/H$ being smaller than half of the cross-sectional width dimension D of the wire material 222A, when a displacement occurs in the horizontal direction A of the coil spring 222, adjacent faces of the wire material 222A touch one another, such that the wire material 222A limitingly abuts together. Here, as the size of the coil spring 222 that is employed in the seismic isolation apparatus 210 of the present embodiment, the height H is, for example, 65 mm and a diameter D1 is, for example, 45 mm.

Next, production of the seismic isolation apparatus 210 relating to the present embodiment will be described.

When this seismic isolation apparatus 210 is to be fabricated, first, the helical coil spring 222 is fabricated of the wire material 222A whose cross-sectional shape is formed to be rectangular. For a Mn—Cu—Ni—Fe alloy, a temperature of around 850° C. is maintained for around 1 hour, after which slow cooling is performed by air-cooling. Further, for a Cu—Al—Mn—Co alloy, a temperature of around 900° C. is maintained for around 5 minutes, after which rapid cooling and re-heating are performed, and 200° C. is maintained for around 15 minutes, after which air-cooling is performed. Thus, it is possible to form the coil spring 222 of twin crystals.

Separately, the rubber rings 218 and the metal rings 220 are laminated to form the outer side laminated body 216. Thus, the outer side laminated body 216 is fabricated. Here, the pair of connection plates 212 and 214 are adhered by vulcanization and attached to the top and bottom, respectively, of the outer side laminated body 216. Here, the outer side laminated body 216 is fabricated such that a height of the outer side laminated body 216 is less than the height of the coil spring 222.

Thereafter, the coil spring 222 is passed through the through-hole 212A of the connection plate 212 and inserted into the cavity portion 224 which is formed at the middle of the outer side laminated body 216. Then, the lid members 232 are respectively screwed on and attached to the connection plates 212 and 214. Thus, the seismic isolation apparatus 210 is completed.

At this time, the coil spring 222 which has been formed to be higher than the height of the outer side laminated body 216 is compressed so as to be the same height as the outer side laminated body 216 in accordance with the lid members 232 being screwed to the connection plates 212 and 214. Thus, the coil spring 222 is compressed into a state in which pre-straining is applied thereto.

Next, operations of the seismic isolation apparatus 210 relating to the present embodiment will be described.

According to the seismic isolation apparatus 210 of the present embodiment, structure is formed in which the coil spring 222 which is resiliently deformably, helically formed of the twin crystal metallic material is disposed inside the outer side laminated body 216 with the form in which the metal rings 220 which include stiffness and are formed in the ring shape and the rubber rings 218 which include resilience and are formed in the ring shape are alternately laminated. Further, as shown in FIGS. 10 and 11, the cross-sectional shape of the wire material 222A structuring the coil spring 222 is formed in the rectangular form with long sides of the quadrilateral being along the radial direction R of the coil spring 222.

Figure 12:
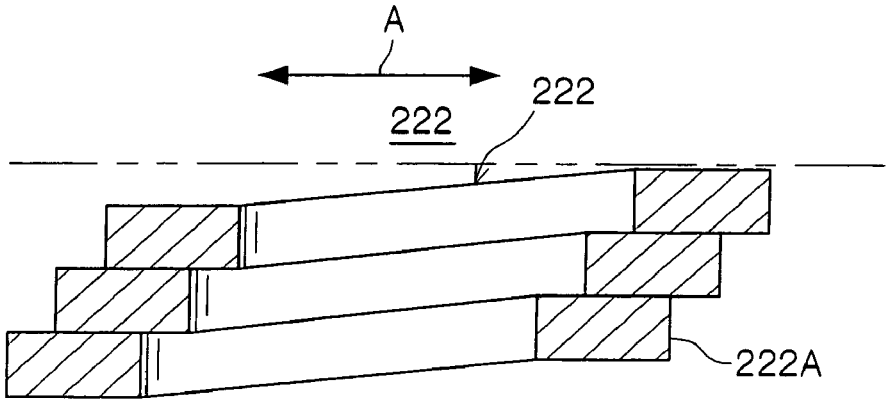
FIG. 12 is an enlarged view of principal elements, showing an enlargement of principal elements of a coil spring in a state in which a displacement is applied to a seismic isolation apparatus relating to a fourth embodiment of the present invention.

Thus, in the present embodiment, when a displacement in the horizontal direction A is inputted to the seismic isolation apparatus 210, rather than the coil spring 222 made of metal whose wire material 222A has a cross-sectional shape which is a rectangle simply deforming to match the input of displacement, neighboring faces of the wire material 222A whose cross-sectional shape is a rectangle touch one another at this time, as shown in FIG. 12. Thus, the wire material 222A limitingly abuts together and a collapse of the coil spring 222 can be automatically prevented.

Consequently, even when a large displacement in the horizontal direction A is applied to the seismic isolation apparatus 210, the coil spring 222 will not be crushed. Therefore, stable damping capabilities will be exhibited even after repeated displacements, and damping characteristics can be stably preserved. Therefore, according to the seismic isolation apparatus 210 relating to the present embodiment, when an earthquake occurs, earthquake shaking is reliably mitigated by compound action of the outer side laminated body 216, which is disposed in parallel with the coil spring 222 and resiliently deforms, with the coil spring 222, and the earthquake shaking is less likely to be propagated to the building.

Furthermore, the seismic isolation apparatus 210 relating to the present embodiment, in which the coil spring 222 made of metal is disposed inside the outer side laminated body 216 with the cross-sectional shape of the wire material 222A being formed as a rectangle with long sides of the quadrilateral in the radial direction of the coil spring 222, provides damping characteristics as described above without employing a lead material. Therefore, the seismic isolation apparatus 210 features damping characteristics equivalent to or better than a conventional seismic isolation apparatus 210 without imposing a burden on the environment.

In the present embodiment, in accordance with the wire material 222A that structures the resiliently deformable, helical coil spring 222 being formed by the twin crystal metallic material, pre-straining is applied to the twin crystal metallic material structuring the wire material 222A of the coil spring 222. Hence, in comparison with a simple twin crystal alloy, when a tensile force, a shearing force or the like is applied, a spring constant is lower and an attenuation coefficient is higher. Thus, the present embodiment features large damping characteristics equivalent to or better than a conventional damping alloy.

That is, when an external stress is applied to the coil spring 222, the pre-straining has been applied and the coil spring 222 has already been deformed to the point P in the region F1 of the stress-strain curve of FIG. 6 along which twin crystal deformation occurs. When the external stress is applied, the coil spring 222 is deformed as shown by arrow E in the region F1 along which twin crystal deformation occurs, in a form in which the twin crystal deformation is made even larger or a form in which the twin crystal deformation is made smaller.

Consequently, because the pre-straining has been applied to the twin-crystal coil spring 222, a reduction of the spring constant can be anticipated, and a range covered by a hysteresis curve F, which includes the region F1 of the stress-strain curve of FIG. 6, can be made larger. Thus, correspondingly effective and excellent damping characteristics are provided.

Figure 13:
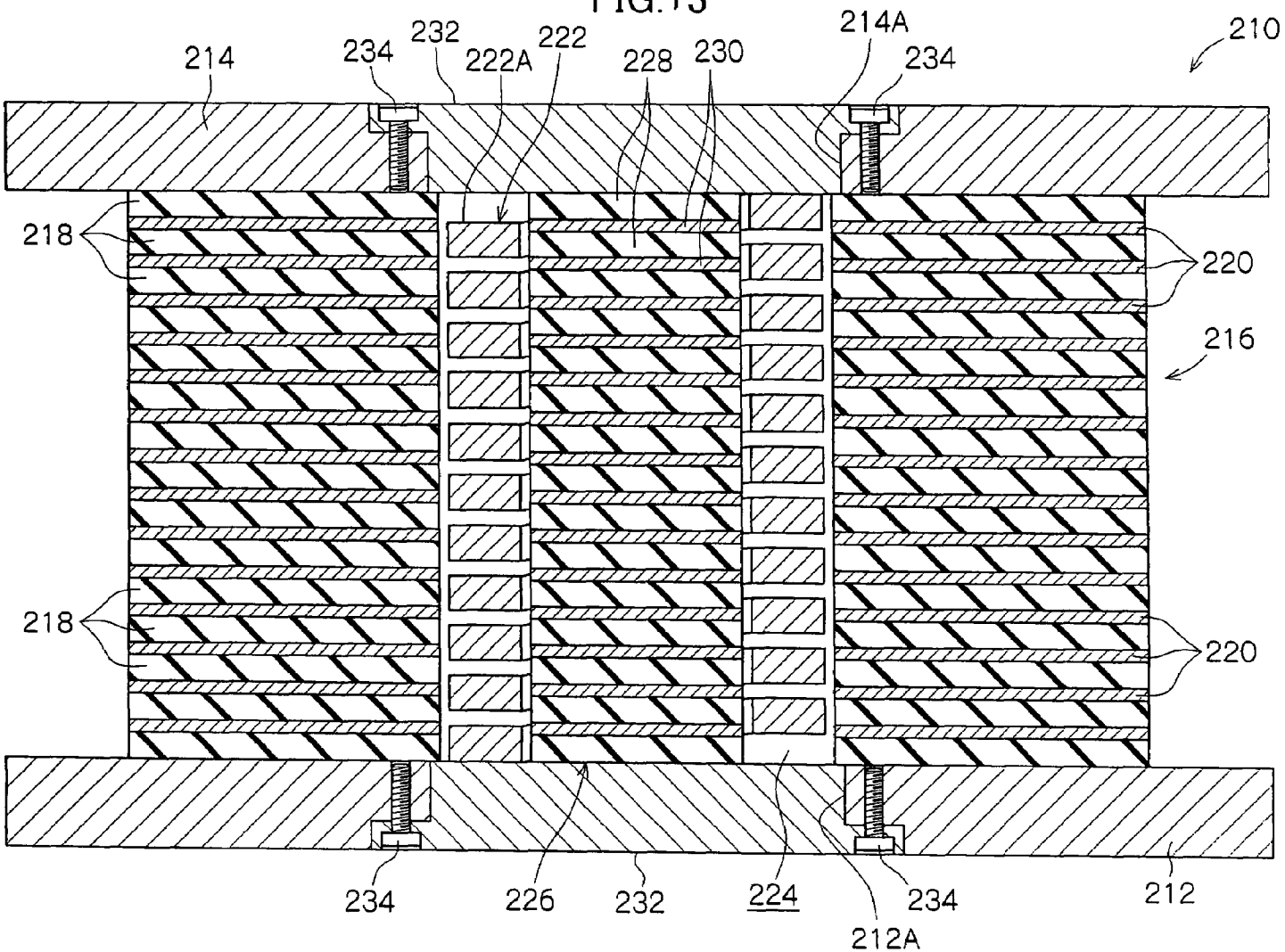
FIG. 13 is a sectional view of the seismic isolation apparatus relating to the fourth embodiment of the present invention.

Next, a fourth embodiment of the seismic isolation apparatus relating to the present invention will be described on the basis of FIG. 13. Note that members that are the same as members described for the third embodiment are assigned the same reference numerals, and duplicative descriptions are omitted.

According to the seismic isolation apparatus 210 of the present embodiment, similarly to the third embodiment, the coil spring 222 is formed by the wire material 222A of the twin crystal metallic material with the cross-sectional shape thereof being a rectangular form, and the coil spring 222 is disposed inside the outer side laminated body 216. In addition, as shown in FIG. 13, the seismic isolation apparatus 210 has structure in which an inner side laminated body 226 is disposed at the inner peripheral side of the coil spring 222. The inner side laminated body 226 is structured in a form in which a metal plate 230 and a rubber plate 228 are plurally alternatingly disposed. The metal plate 230 is an inner side stiff plate which features rigidity and is formed in a disc shape. The rubber plate 228 is an inner side resilient plate which features resilience and is formed in a disc shape.

That is, in the third embodiment, the coil spring 222 in which the cross-sectional shape of the wire material 222A is formed as a rectangle so as to consistently deform to match inputs of displacement is employed, but the present embodiment has further structure in which the inner side laminated body 226 is inserted at the inner side of the coil spring 222 to serve as a support material, and thus the coil spring 222 and the inner side laminated body 226 are incorporated at the outer side laminated body 216.

Hence, the inner side laminated body 226 restricts deformation of the coil spring 222 when a displacement in the horizontal direction A is inputted to the seismic isolation apparatus 210. Thus, even when large displacements in the horizontal direction A are applied, the coil spring 222 will more assuredly not be crushed, stable damping capabilities will be exhibited even after repeated displacements, and damping characteristics can be more stably preserved.

Consequently, according to the seismic isolation apparatus 210 relating to the present embodiment, earthquake shaking is reliably mitigated by compound action of the outer side laminated body 216 with the coil spring 222. In addition, because the inner side laminated body 226 in which the metal plates 230 and the rubber plates 228 are laminated is disposed at the inner side of the coil spring 222 to serve as the support material, earthquake shaking is even less likely to be propagated to the building. Therefore, similarly to the first embodiment, the damping characteristics described above can be provided even without employing a lead material. Therefore, the seismic isolation apparatus 210 features damping characteristics equivalent to or better than a conventional seismic isolation apparatus 210 without imposing a burden on the environment.

Figure 14:
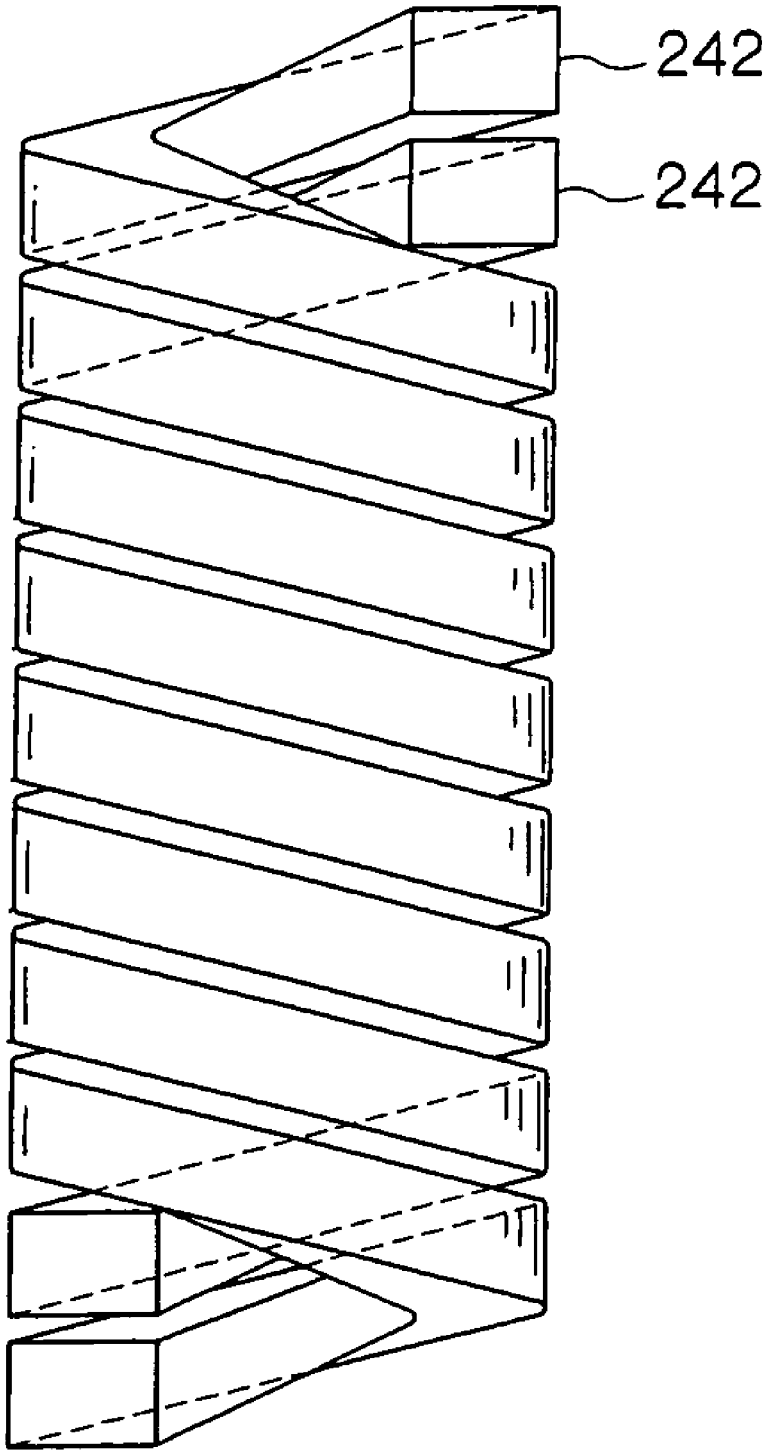
FIG. 14 is a front view of coil springs which are employed in a seismic isolation apparatus relating to a fifth embodiment of the present invention.

Next, a fifth embodiment of the seismic isolation apparatus relating to the present invention will be described on the basis of FIG. 14. Note that members that are the same as members described for the third embodiment are assigned the same reference numerals, and duplicative descriptions are omitted.

The seismic isolation apparatus 210 relating to the present embodiment is structured similarly to the third embodiment. However, there is a plurality (two in the present embodiment) of coil springs 242 with the same diameter. The plurality of coil springs 242 are coaxially combined as shown in FIG. 14 and are disposed in a dually superposed state inside the cavity portion 224 formed at the middle of the outer side laminated body 216.

Thus, because the plurality of coil springs 242 are coaxially combined and disposed, length of each of the coil springs 242 is shorter. Consequently, an apparent spring constant is raised, and the plurality of coil springs 242 can be disposed in an integrated stack. As a result, a required attenuating force can easily be set by a number of the superposed coil springs 242.

For the present embodiment, the use of, for example, any of the following twin crystal metallic materials can be considered: a Cu—Al—Mn alloy, a Mg—Zr alloy, a Mn—Cu alloy, a Mn—Cu—Ni—Fe alloy, a Cu—Al—Ni alloy, a Ti—Ni alloy, an Al—Zn alloy, a Cu—Zn—Al alloy, a Mg alloy, a Cu—Al—Co alloy, a Cu—Al—Mn—Ni alloy, a Cu—Al—Mn—Co alloy, a Cu—Si alloy, an Fe—Mn—Si alloy, an Fe—Ni—Co—Ti alloy, an Fe—Ni—C alloy, an Fe—Cr—Ni—Mn—Si—Co alloy, a Ni—Al alloy, and SUS304.

That is, when one of these metals is employed as the twin crystal metallic material for forming the wire material 222A which structures the coil spring 222 or coil springs 242, the coil spring 222 or coil springs 242 featuring damping characteristics equivalent to or better than prior art can be more assuredly provided without burdening the environment.

For example, if a manganese-based alloy such as a Mn—Cu alloy, a Mn—Cu—Ni—Fe alloy or the like is employed, the twin crystal metallic material is obtained by maintaining a temperature of 800° C. to 930° C. for a duration of around 0.5 to 2 hours, and slowly cooling over a duration of around 10 to 20 hours.

Further, if a copper-based alloy such as a Cu—Al—Mn alloy, a Cu—Al—Ni alloy, a Cu—Zn—Al alloy, a Cu—Al—Co alloy, a Cu—Al—Mn—Ni alloy, a Cu—Al—Mn—Co alloy, a Cu—Si alloy or the like is employed, the twin crystal metallic material is obtained by maintaining a temperature of about 900° C. for a duration of around 5 minutes to 1 hour, rapidly cooling, and then re-heating to a temperature of about 200° C. and maintaining this temperature for a duration of around 15 to 30 minutes.

Note that although the number of coil springs in the fourth embodiment described above is set to two, there may be three or more coil springs. Furthermore, in the embodiments described above, a twin crystal metallic material is employed as the material of the wire material(s) structuring the coil spring(s). However, a different, ordinary metallic material could be employed as the spring material.

In the third to fifth embodiments described above, the cross-sectional shape of the wire material structuring the coil spring(s) has a rectangular shape with long sides of this quadrilateral in a coil spring radial direction. However, as long as the operations and effects of the present invention are fulfilled, a rectangular form with short sides along the coil spring radial direction is also possible, and a square form is possible too. Furthermore, when the cross-sectional shape of a wire material structuring a coil spring is formed as a quadrilateral, a cross-sectional area of a radially innermost portion, at which it is thought that straining amounts of the coil spring will be largest, is increased relative to a circular cross-section, and strength of the coil spring is improved.

Furthermore, the seismic isolation apparatuses relating to the third to fifth embodiments described above have structures in which the coil spring is constrained from above and below by lid members. However, instead of this, it is possible to employ a structure such that upper and lower ends of the coil spring are fixed at the lid members by the use of fixing fixtures such as screws or the like, to form a structure such that the coil spring more consistently follows displacements of the seismic isolation apparatus.

Figure 15:
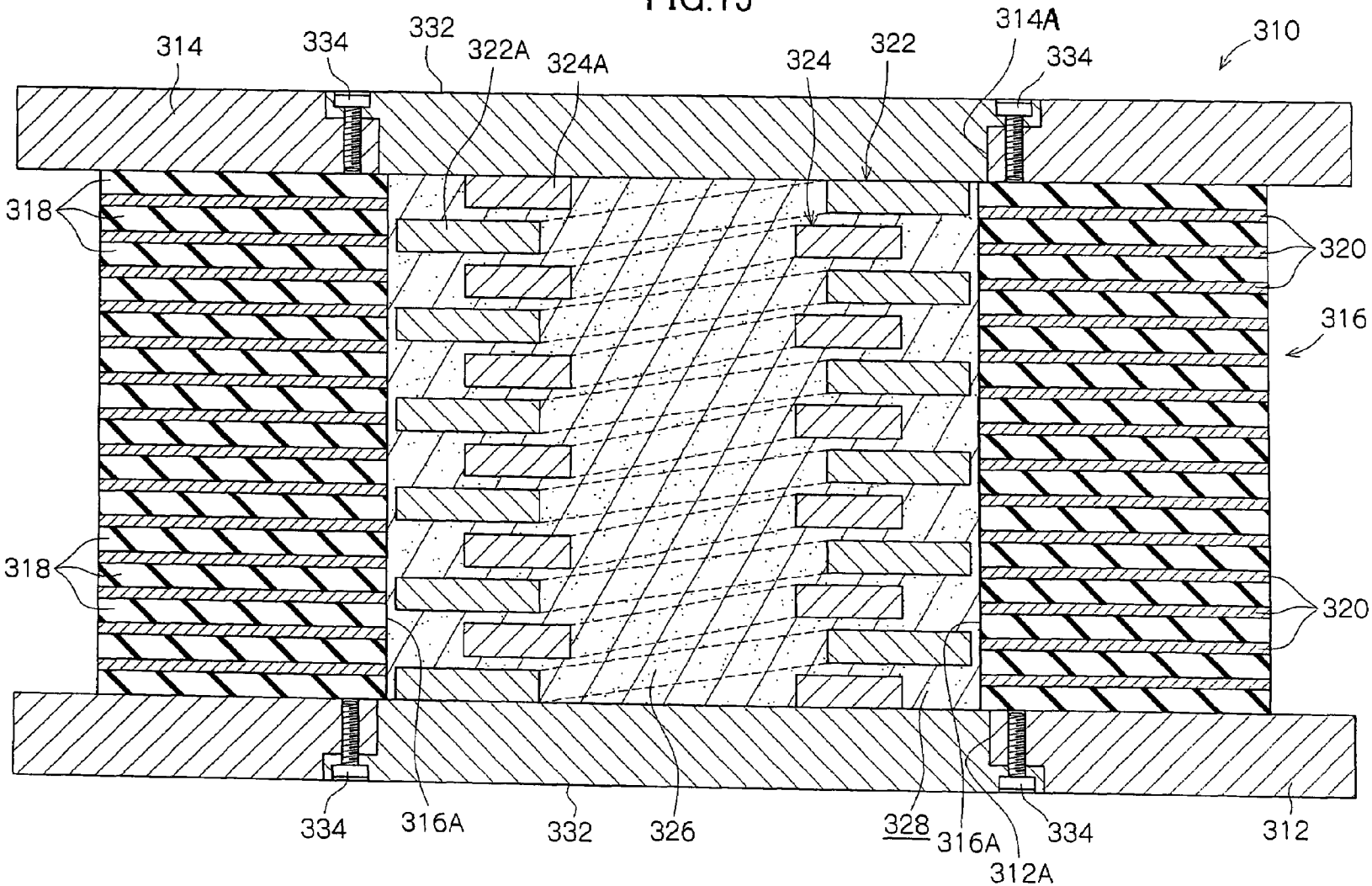
FIG. 15 is a sectional view of a seismic isolation apparatus relating to a sixth embodiment of the present invention.

A sixth embodiment of the seismic isolation apparatus relating to the present invention will be described on the basis of FIGS. 15 to 18. As shown in FIG. 15, top and bottom portions of a seismic isolation apparatus 310 relating to the sixth embodiment of the present invention are structured by connection plates 312 and 314, which are each formed in a circular plate shape. In this structure, the lower of these, the connection plate 312, abuts against the ground and the upper connection plate 314 abuts against a lower portion of a building.

An outer side laminated body 316 is disposed between this pair of connection plates 312 and 314. The outer side laminated body 316 is formed in a tubular shape which is provided with an inner periphery plate 316A so as to include a tubular cavity portion 328 at a central portion thereof. The outer side laminated body 316 is structured in a form in which a rubber ring 318 fabricated of rubber and a metal ring 320 fabricated of metal are plurally alternatingly disposed. The rubber ring 318 is an outer side resilient plate, which is formed in a ring shape and is capable of resilient deformation. The metal ring 320 is an outer side stiff plate for maintaining rigidity, which is formed in a ring shape.

These two connection plates 312 and 314 are respectively adhered by vulcanization to be attached to upper and lower ends, respectively, of the outer side laminated body 316. At centers of this pair of connection plates 312 and 314, circular through-holes 312A and 314A, each of which includes an intermediate step portion, are formed. Further, lid members 332 with sizes corresponding to the through-holes 312A and 314A, which include flanges at outer peripheral sides thereof, are screwed on by bolts 334. Thus, the lid members 332 are fixed to each of the pair of connection plates 312 and 314 to close off the respective through-holes 312A and 314A.

A coil spring 322 is disposed so as to fit snugly in the cylindrical cavity portion 328 formed in the middle of the outer side laminated body 316. The coil spring 322 is formed of a wire material 322A of a twin crystal metallic material, a cross-sectional shape of which has a rectangular form, in the form of a resiliently deformable, helical coil spring. Similarly, a coil spring 324 is formed of a wire material 324A of a twin crystal metallic material, a cross-sectional shape of which has a rectangular form, in the form of a resiliently deformable, helical coil spring. The coil spring 324 is coaxially combined with the coil spring 322 and disposed so as to fit snugly in the cavity portion 328 of the outer side laminated body 316. Here, external diameters of the coil spring 322 and the coil spring 324 are mutually different, with the external diameter of the coil spring 322 being larger than the external diameter of the coil spring 324.

That is, in the present embodiment, the cross-sectional shapes of the wire materials 322A and 324A which structure the two coil springs 322 and 324, respectively, are formed as rectangles with long sides of these quadrilateral forms in a radial direction R of the coil springs 322 and 324. Herein, the Young's modulus of these wire materials 322A and 324A is, for example, around 47 GPa. The pitches of the two coil springs 322 and 324 are expected to be substantially the same as one another, but may differ from one another.

In addition to the coil springs 322 and 324, an influx material 326 fabricated of rigid urethane is influxed to be disposed in the cavity portion 328 of the outer side laminated body 316. The influx material 326 is capable of restricting movements of the coil springs 322 and 324 to forms along deformations of the outer side laminated body 316.

Further, the seismic isolation apparatus 310 relating to the present embodiment has a structure in which the outer side laminated body 316 which is capable of resilient deformation is disposed in parallel with the coil springs 322 and 324 which are helically formed of the twin crystal metallic material so as to be resiliently deformable. Further, heights of the coil springs 322 and 324 in a free state are greater than a height of the outer side laminated body 316. Accordingly, in the state shown in FIG. 15 in which the coil springs 322 and 324 have been assembled into the outer side laminated body 316, this is a form in which the coil springs 322 and 324 are compressed by the lid members 332 and pre-straining is applied to these coil springs 322 and 324.

Figure 16:
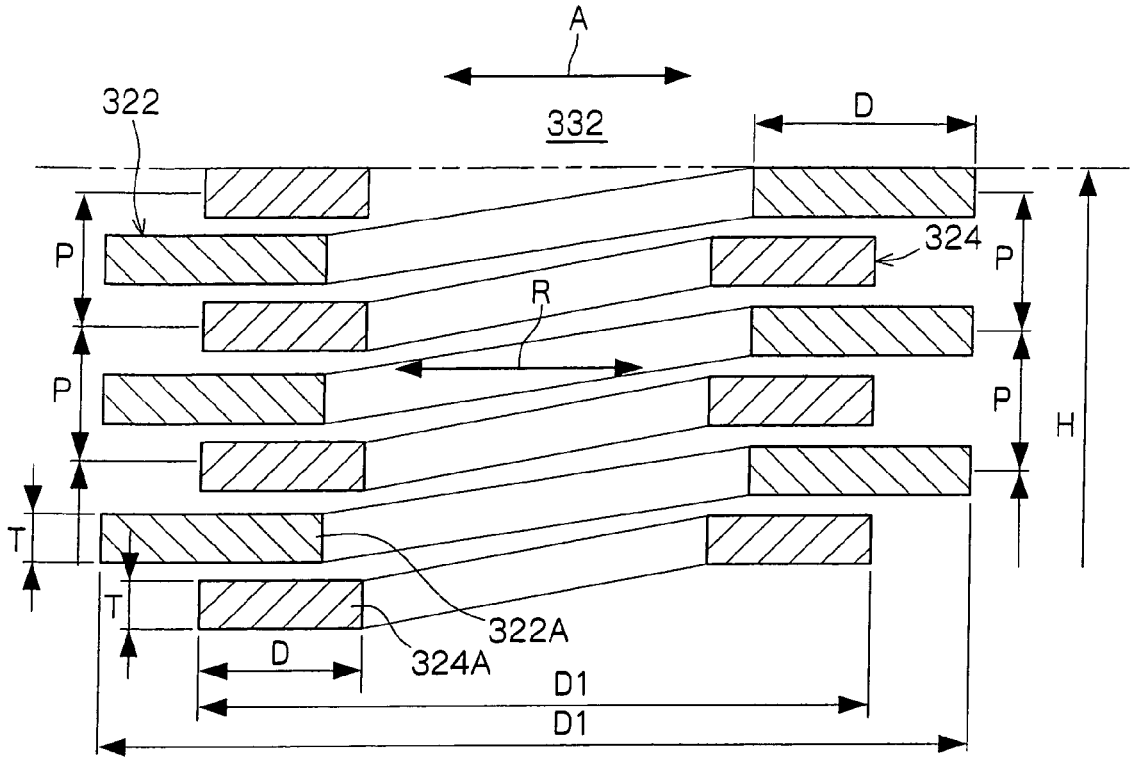
FIG. 16 is an enlarged view of principal elements, showing an enlargement of principal elements of coil springs of the seismic isolation apparatus relating to the sixth embodiment of the present invention.

Herein, as shown in FIG. 16, a height H of the coil springs 322 and 324 in the state in which the coil springs 322 and 324 have been assembled into the seismic isolation apparatus 310 is, for example, 65 mm, an external diameter D1 of the coil spring 322 is, for example, 62 mm, an external diameter D1 of the coil spring 324 is, for example, 45 mm, and an external diameter ratio of these two coil springs 322 and 324 is considered to be appropriate in a range of around 5:4 to 5:2.5. Further, a pitch P of each of the wire materials 322A and 324A structuring the coil springs 322 and 324 is, for example, 12 mm, a plate width dimension D of each of the wire materials 322A and 324A is, for example, 12 mm, and a plate thickness dimension T of each of the wire materials 322A and 324A is, for example, 4 mm.

Accordingly, when an expected maximum displacement amount in the horizontal direction A arises at the coil springs 322 and 324, faces of the wire material 322A of the coil spring 322 touch neighboring faces of the wire material 324A of the coil spring 324, and the wire materials 322A and 324A limitingly abut together.

Next, production of the seismic isolation apparatus 310 relating to the present embodiment will be described.

When this seismic isolation apparatus 310 is to be fabricated, first, the two helical coil springs 322 and 324 with mutually differing external diameters are fabricated, respectively, of the wire materials 322A and 324A whose cross-sectional shapes are formed to be rectangular. For a Mn—Cu—Ni—Fe alloy, a temperature of around 850° C. is maintained for around 1 hour, after which slow cooling is performed by air-cooling. Further, for a Cu—Al—Mn—Co alloy, a temperature of around 900° C. is maintained for around 5 minutes, after which rapid cooling and re-heating are performed, and 200° C. is maintained for around 15 minutes, after which air-cooling is performed. Thus, it is possible to form the coil springs 322 and 324 of twin crystals.

Separately, the rubber rings 318 and the metal rings 320 are laminated to form the outer side laminated body 316. Thus, the outer side laminated body 316 is fabricated. Here, the pair of connection plates 312 and 314 are adhered by vulcanization and attached to the top and bottom, respectively, of the outer side laminated body 316. Further, the outer side laminated body 316 is fabricated such that a height of the outer side laminated body 316 is less than the heights of the coil springs 322 and 324.

Thereafter, the wire material 324A of the coil spring 324 whose external diameter is smaller than the coil spring 322 is assembled so as to be threaded in between the wire material 322A of the coil spring 322, such that the wire materials 322A and 324A of the coil springs 322 and 324 are fitted together each between the wire material of the other. The coil springs 322 and 324 in this combined state are passed through the through-hole 312A of the connection plate 312 and inserted into the cavity portion 328 which is formed at the middle of the outer side laminated body 316.

Figure 18:
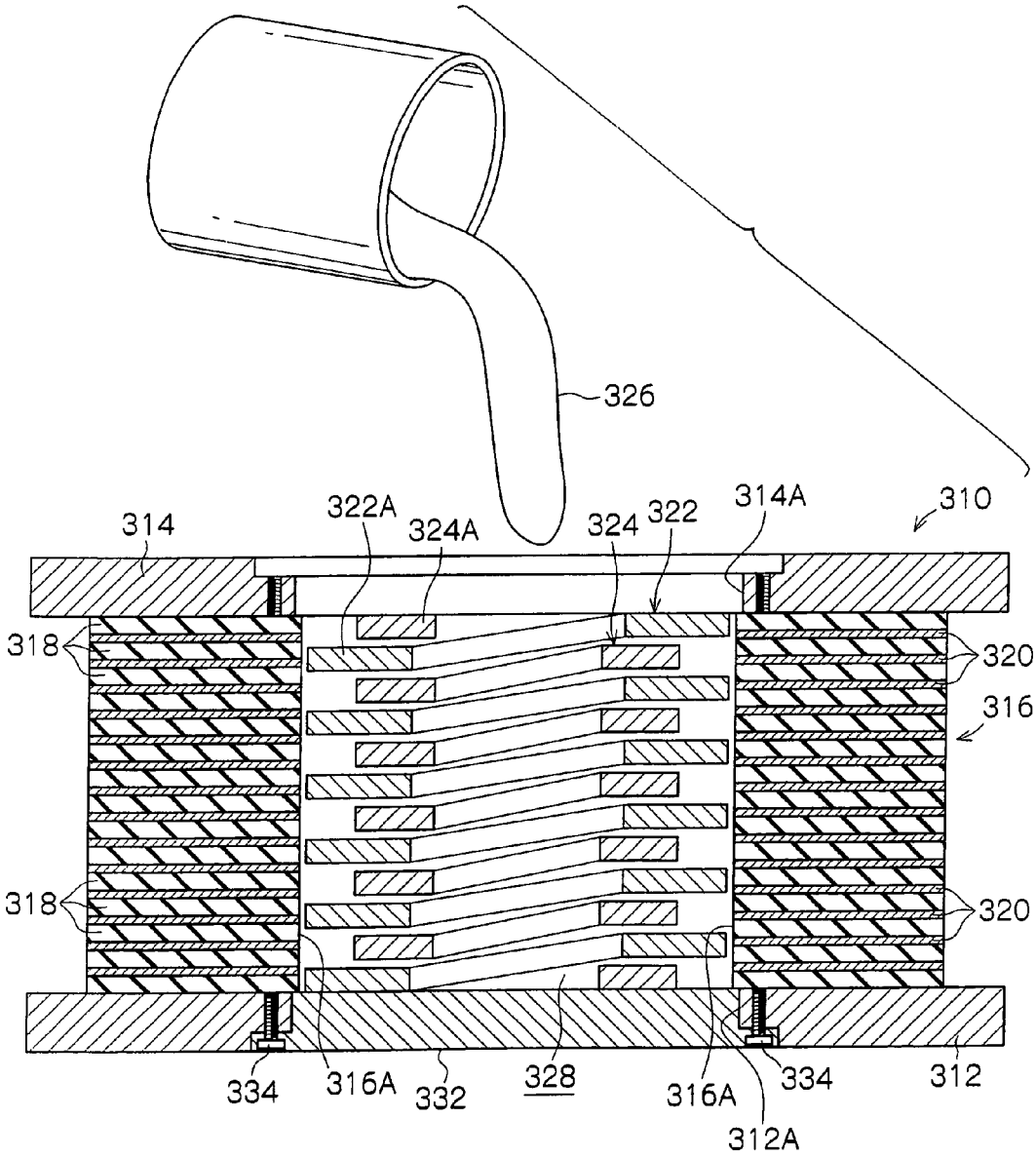
FIG. 18 is a sectional view of the seismic isolation apparatus relating to the sixth embodiment of the present invention, showing a state in which an influx material is pouring in during assembly of the seismic isolation apparatus.

Then, the lid member 332 is screwed on and attached to the connection plate 312. In this state, as shown in FIG. 18, the influx material 326, in a liquid form, is poured into the cavity portion 328 and fills in gaps between the coil springs 322 and 324. In this state, the influx material 326 is solidified, and the other lid member 332 is screwed on and attached to the connection plate 314. Thus, the seismic isolation apparatus 310 is completed.

At this time, the coil springs 322 and 324 which have been formed to be higher than the height of the outer side laminated body 316 are compressed so as to be the same height as the outer side laminated body 316 in accordance with the lid members 332 being screwed to the connection plates 312 and 314. Thus, the coil springs 322 and 324 are compressed into a state in which pre-straining is applied thereto.

Next, operations of the seismic isolation apparatus 310 relating to the present embodiment will be described.

According to the seismic isolation apparatus 310 of the present embodiment, the seismic isolation apparatus 310 includes the outer side laminated body 316, which is formed by the metal rings 320 which include stiffness and are formed in the ring shape and the rubber rings 318 which include resilience and are formed in the ring shape being alternately laminated.

Further, in this structure, the two coil springs 322 and 324 with mutually different external diameters, which are respectively formed of the twin crystal metallic material to be resiliently deformable and helical, are disposed coaxially with one another in the cavity portion 328 at the central portion of the outer side laminated body 316, and the influx material 326 which is capable of restricting movement of these coil springs 322 and 324 is solidified in a state in which the influx material 326 has flowed into the outer side laminated body 316 and filled in the gaps. Further, as shown in FIGS. 15 and 16, cross-sectional shapes of the wire materials 322A and 324A structuring the coil springs 322 and 324, respectively, are formed to be rectangular with the long sides of these quadrilaterals along the radial direction R of the coil spring 322.

Figure 17:
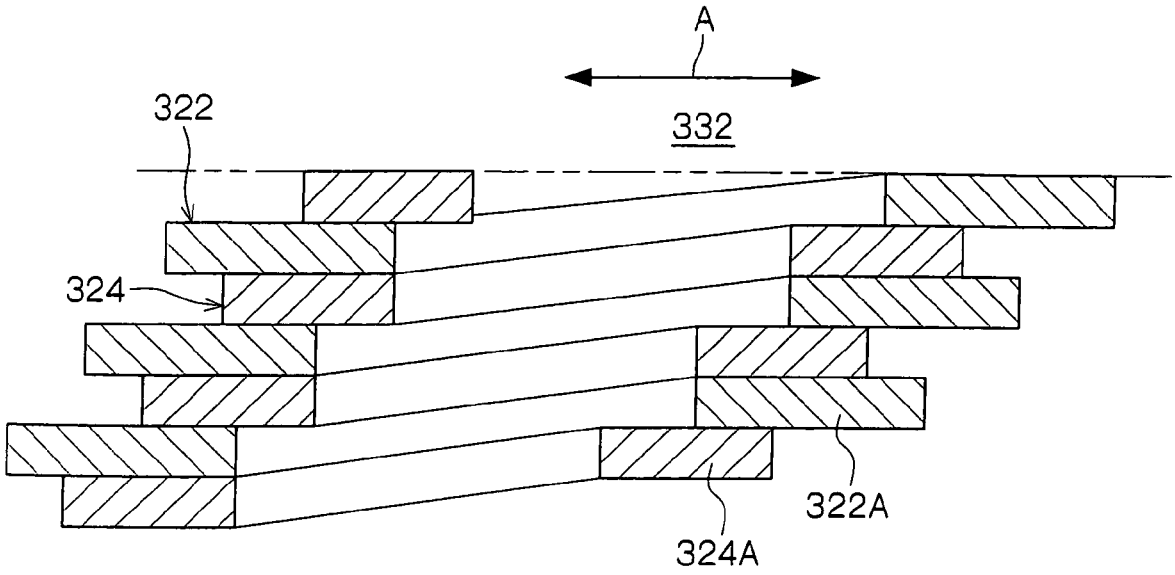
FIG. 17 is an enlarged view of principal elements, showing an enlargement of the principal elements of the coil springs in a state in which a displacement is applied to the seismic isolation apparatus relating to the sixth embodiment of the present invention.

Thus, in the present embodiment, when a displacement in the horizontal direction A is inputted to the seismic isolation apparatus 310, rather than the coil springs 322 and 324 made of metal whose wire materials 322A and 324A have cross-sectional shapes which are rectangles simply respectively deforming to match the input of displacement, neighboring faces of the wire materials 322A and 324A whose cross-sectional shapes are rectangles touch one another at this time, as shown in FIG. 17. Thus, the wire materials 322A and 324A limitingly abut together. Moreover, the influx material 326 which has been influxed into the outer side laminated body 316 adheres to the inner periphery plate 316A of the outer side laminated body 316 and each of the coil springs 322 and 324, and this influx material 326 restricts movements of the coil springs 322 and 324 to forms along the deformation of the outer side laminated body 316.

Therefore, according to the present embodiment, as well as the wire materials 322A and 324A of the coil springs 322 and 324 limitingly abutting together, the influx material 326 restricts movement of the coil springs 322 and 324. Thus, a collapse of the coil springs 322 and 324 can be automatically prevented.

Consequently, even when a large displacement in the horizontal direction A is applied to the seismic isolation apparatus 310, the coil springs 322 and 324 will not be crushed. Therefore, stable damping capabilities will be exhibited even after repeated displacements, and damping characteristics can be stably preserved. Therefore, according to the seismic isolation apparatus 310 relating to the present embodiment, when an earthquake occurs, earthquake shaking is reliably mitigated by both compound action of the outer side laminated body 316 with the coil springs 322 and 324, which are disposed in parallel with one another and each resiliently deform, and further compound action thereof with the influx material 326. Thus, the earthquake shaking is less likely to be propagated to the building.

Furthermore, the seismic isolation apparatus 310 relating to the present embodiment, which has structure in which the coil springs 322 and 324 made of metal are disposed inside the outer side laminated body 316 with the cross-sectional shapes of the wire materials 322A and 324A being respectively formed in rectangular forms, with long sides of the quadrilaterals in the radial direction of the coil springs 322 and 324, and with mutually differing diameters and into which the influx material 326 which is capable of restricting movements of the coil springs 322 and 324 has been influxed, provides damping characteristics as described above without employing a lead material. Therefore, the seismic isolation apparatus 310 features damping characteristics equivalent to or better than a conventional seismic isolation apparatus 310 without imposing a burden on the environment.

Further, in the present embodiment, because the two coil springs 322 and 324 are combined coaxially with one another and disposed in the outer side laminated body 316, even if space in the cavity portion 328 at the middle portion of the outer side laminated body 316 is tight, it is possible to dispose the coil springs 322 and 324 to make maximum possible use of the space. Further, because the two coil springs 322 and 324 are coaxially combined and disposed, lengths of each of the wire materials which helically form the coil springs 322 and 324 are short, and accordingly the spring constants of the coil springs 322 and 324 are higher.

In the present embodiment, in accordance with the wire materials 322A and 324A that structure the resiliently deformable, helical coil springs 322 and 324 being formed by the twin crystal metallic material, pre-straining is applied to the twin crystal metallic materials structuring these wire materials 322A and 324A. Hence, in comparison with a simple twin crystal alloy, when a tensile force, a shearing force or the like is applied, a spring constant is lower and an attenuation coefficient is higher. Thus, the present embodiment features large damping characteristics equivalent to or better than a conventional damping alloy.

That is, when an external stress is applied to the coil springs 322 and 324, the pre-straining has been applied and the coil springs 322 and 324 have already been deformed to the point P in the region F1 of the stress-strain curve of FIG. 6 along which twin crystal deformation occurs. When the external stress is applied, the coil springs 322 and 324 are deformed as shown by arrow E in the region F1 along which twin crystal deformation occurs, in a form in which the twin crystal deformation is made even larger or a form in which the twin crystal deformation is made smaller.

Consequently, because the pre-straining has been applied to the twin-crystal coil springs 322 and 324, a reduction of the spring constant can be anticipated, and a range covered by a hysteresis curve F, which includes the region F1 of the stress-strain curve of FIG. 6, can be made larger. Thus, correspondingly effective and excellent damping characteristics are provided.

Now, in the present embodiment, of synthetic resin materials, the influx material 326 is formed of a rigid urethane with a large extension amount, which has a comparatively high elastic coefficient but is hard. Thus, restraining force on the coil springs 322 and 324 is raised and crushing of the coil springs 322 and 324 can be more reliably prevented, even when displacement amounts are large.

Figure 19:
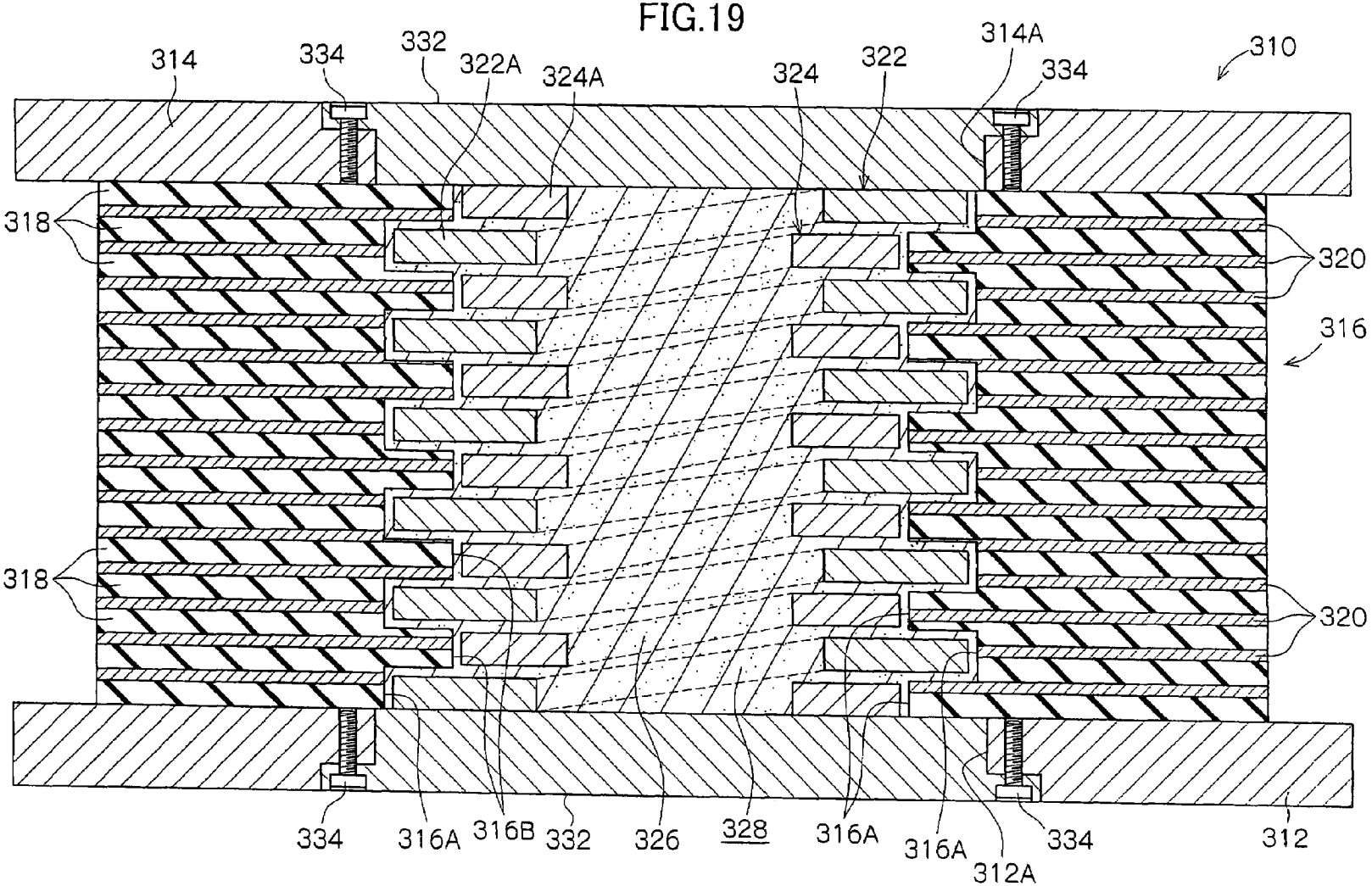
FIG. 19 is a sectional view of a seismic isolation apparatus relating to a seventh embodiment of the present invention.

Next, a seventh embodiment of the seismic isolation apparatus relating to the present invention will be described on the basis of FIG. 19. Note that members that are the same as members described for the sixth embodiment are assigned the same reference numerals, and duplicative descriptions are omitted.

According to the seismic isolation apparatus 310 of the present embodiment, similarly to the sixth embodiment, the coil springs 322 and 324 are formed by the respective wire materials 322A and 324A of the twin crystal metallic material with the cross-sectional shapes thereof being rectangular forms, the two coil springs 322 and 324 with different external diameters are mutually coaxially disposed in the cavity portion 328 at the central portion of the outer side laminated body 316, and the influx material 326 is influxed into the outer side laminated body 316. In addition, as shown in FIG. 19, the seismic isolation apparatus 310 has structure in which the inner periphery plate 316A of the outer side laminated body 316 is formed with protrusions and indentations corresponding with outer peripheral face side shapes of the plurality of two coil springs 322 and 324.

That is, the sixth embodiment is structured with the coil springs 322 and 324 and the influx material 326 disposed in the cavity portion 328 of the outer side laminated body 316. Further, in the present embodiment, regions of the inner periphery plate 316A that correspond with the coil spring 324 with the smaller external diameter are formed as a protrusion 316B which protrudes to the inner peripheral side in a helical form, with a height of, for example, 7 mm relative to regions corresponding to the coil spring 322 with the larger external diameter, so as to correspond with the outer peripheral face side shape of the coil springs 322 and 324.

Thus, because the inner periphery plate 316A of the outer side laminated body 316 is formed in the indented/protruding form, in the present embodiment, the protrusion 316B protruding from the inner periphery plate 316A of the outer side laminated body 316 meshes with portions close to the outer peripheral side of the coil spring 322. As a result, movements of the coil springs 322 and 324 are also limited by the inner periphery plate 316A of the outer side laminated body 316, and crushing of the coil springs 322 and 324 can be prevented.

Accordingly, the indentations and protrusions of the inner periphery plate 316A of the outer side laminated body 316 also limit deformation of the coil springs 322 and 324 when a displacement in the horizontal direction A is inputted to the seismic isolation apparatus 310. Thus, even when a large displacement in the horizontal direction A is applied, the coil springs 322 and 324 will more assuredly not be crushed, stable damping capabilities will be exhibited even after repeated displacements, and damping characteristics can be more stably preserved.

As a result, according to the seismic isolation apparatus 310 relating to the present embodiment, earthquake shaking is reliably mitigated by compound action of the outer side laminated body 316 with the coil springs 322 and 324 and the influx material 326. In addition, because the inner periphery plate 316A of the outer side laminated body 316 is formed in the indented/protruding form to correspond with the shape of the outer peripheral face side of the two coil springs 322 and 324, the inner periphery plate 316A of the outer side laminated body 316 meshes with the outer peripheral faces of the coil springs 322 and 324, and earthquake shaking is even less likely to be propagated to the building. Therefore, similarly to the fifth embodiment, the damping characteristics described above can be provided even without employing a lead material. Therefore, the seismic isolation apparatus 310 features damping characteristics equivalent to or better than a conventional seismic isolation apparatus 310 without imposing a burden on the environment.

Figure 20:
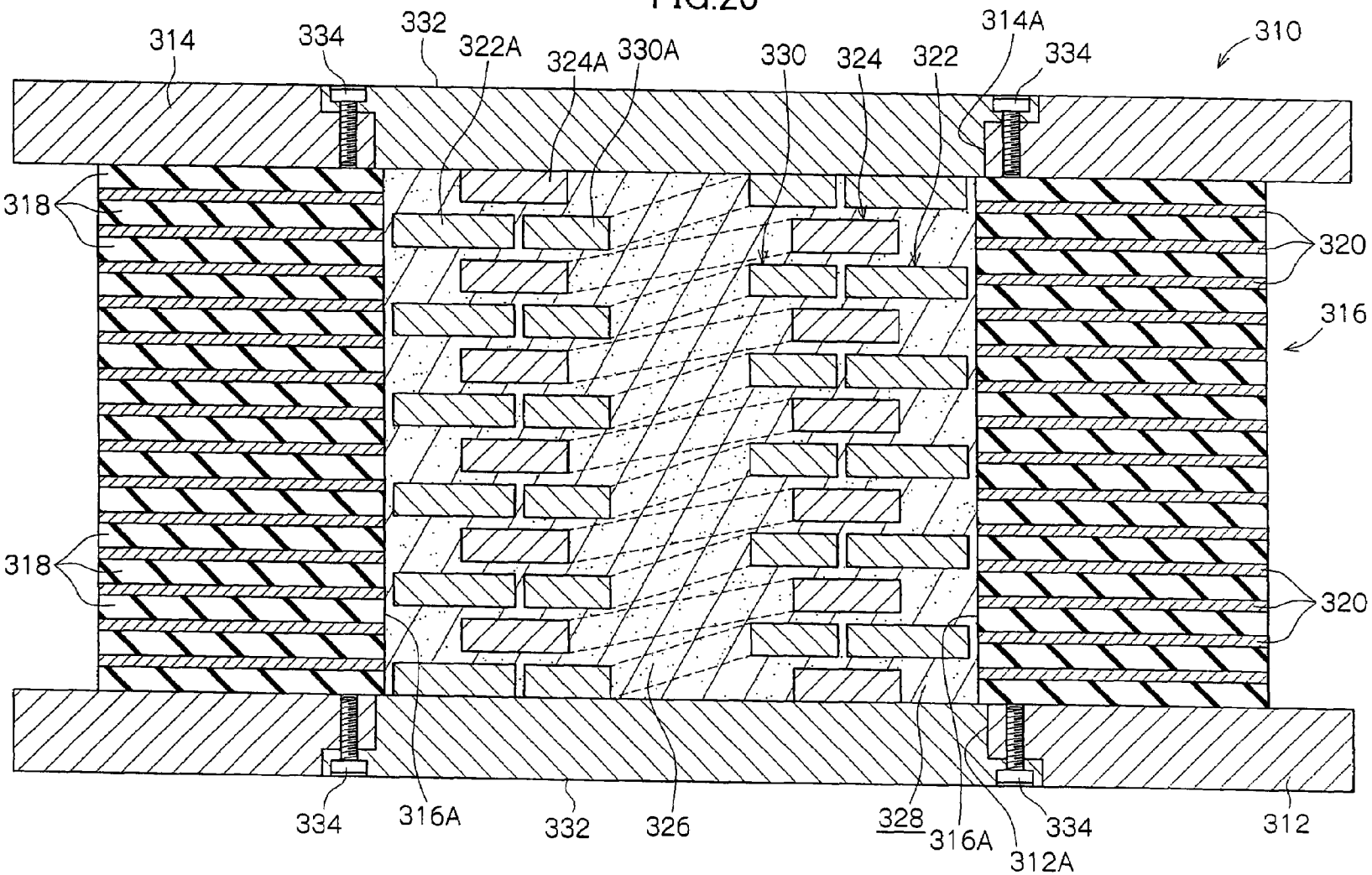
FIG. 20 is a sectional view of a seismic isolation apparatus relating to an eighth embodiment of the present invention.

Next, an eighth embodiment of the seismic isolation apparatus relating to the present invention will be described on the basis of FIG. 20. Note that members that are the same as members described for the sixth embodiment are assigned the same reference numerals, and duplicative descriptions are omitted.

The seismic isolation apparatus 310 relating to the present embodiment is structured similarly to the sixth embodiment. However, in the present embodiment, three coil springs, the coil springs 322 and 324 and a coil spring 330, are coaxially combined. The coil springs 322, 324 and 330 have mutually different external diameters and are formed by the wire materials 322A and 324A and a wire material 330A, respectively, of the twin crystal metallic material with cross-sectional shapes thereof being rectangles. The coil springs 322, 324 and 330 are disposed in a triply superposed state in the cavity portion 328 which is at the middle of the outer side laminated body 316.

That is, the coil spring 330 is disposed at an inner peripheral face side of the coil spring 322, which has a large internal diameter. The coil spring 330 has an external diameter smaller than the internal diameter of the coil spring 322, and is formed with substantially the same pitch as the coil spring 322. Accordingly, in the state in which the three coil springs 322, 324 and 330 are coaxially combined, the coil spring 330 is disposed in the cavity portion 328. Hence, because the three coil springs 322, 324 and 330 are mutually coaxially combined and disposed in the outer side laminated body 316, the tight space inside the outer side laminated body 316 is utilized to the maximum possible, and an apparent spring constant can be raised.

For the embodiments described above, the use of, for example, any of the following twin crystal metallic materials can be considered: a Cu—Al—Mn alloy, a Mg—Zr alloy, a Mn—Cu alloy, a Mn—Cu—Ni—Fe alloy, a Cu—Al—Ni alloy, a Ti—Ni alloy, an Al—Zn alloy, a Cu—Zn—Al alloy, a Mg alloy, a Cu—Al—Co alloy, a Cu—Al—Mn—Ni alloy, a Cu—Al—Mn—Co alloy, a Cu—Si alloy, an Fe—Mn—Si alloy, an Fe—Ni—Co—Ti alloy, an Fe—Ni—C alloy, an Fe—Cr—Ni—Mn—Si—Co alloy, a Ni—Al alloy, and SUS304.

That is, when one of these metals is employed as the twin crystal metallic material for forming the wire materials 322A, 324A and 330A which structure the coil springs 322, 324 and 330, coil springs featuring damping characteristics equivalent to or better than prior art can be more assuredly provided without burdening the environment.

For example, if a manganese-based alloy such as a Mn—Cu alloy, a Mn—Cu—Ni—Fe alloy or the like is employed, the twin crystal metallic material is obtained by maintaining a temperature of 800° C. to 930° C. for a duration of around 0.5 to 2 hours, and slowly cooling over a duration of around 10 to 20 hours.

Further, if a copper-based alloy such as a Cu—Al—Mn alloy, a Cu—Al—Ni alloy, a Cu—Zn—Al alloy, a Cu—Al—Co alloy, a Cu—Al—Mn—Ni alloy, a Cu—Al—Mn—Co alloy, a Cu—Si alloy or the like is employed, the twin crystal metallic material is obtained by maintaining a temperature of about 900° C. for a duration of around 5 minutes to 1 hour, rapidly cooling, and then re-heating to a temperature of about 200° C. and maintaining this temperature for a duration of around 15 to 30 minutes.

Next, a mechanism of deformation of the wire materials 322A, 324A and 330A structuring the coil springs 322, 324 and 330 according to formation with twin crystals will be described with the aforementioned FIGS. 8A to 9B.

Next, results of tests in which an Example of the seismic isolation apparatus and comparative examples of the seismic isolation apparatus are respectively displaced in a horizontal direction will be compared and discussed. First, for the seismic isolation apparatus of the Example, the seventh embodiment was formed as a sample, in which the two coil springs 322 and 324 with mutually differing external diameters and the influx material 326 were disposed in the outer side laminated body 316, in addition to which the inner periphery plate 316A of the outer side laminated body 316 was formed in the indented/protruding form.

Meanwhile, as samples for the comparative examples, a seismic isolation apparatus in which two coil springs were disposed in an outer side laminated body but external diameters of the coil springs were the same as one another and the influx material 326 was not influxed served as a first comparative example, and a seismic isolation apparatus in which the influx material 326 was not influxed and only one coil spring was disposed in an outer side laminated body served as a second comparative example.

Figure 21:
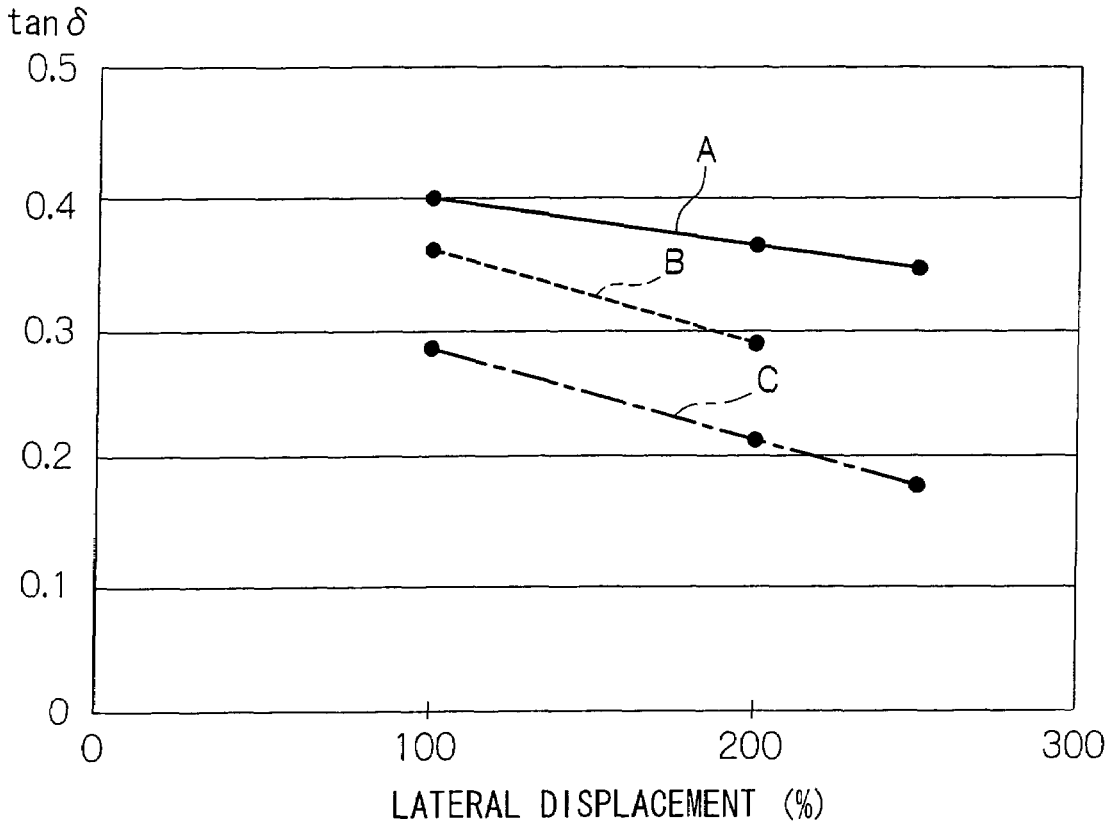
FIG. 21 is a view showing a graph representing deformations, by tanδ, with respect to horizontal displacements of samples in relation to the seventh embodiment of the present invention.

FIG. 21 shows a graph of test results in which values of tanδ measured when the seismic isolation apparatuses serving as samples were horizontally displaced in ranges of around 100% to 200% were measured. Here, in this graph, the Example is represented by characteristic curve A, the first comparative example is represented by characteristic curve B, and the second comparative example is represented by characteristic curve C. The characteristics are shown with a horizontal displacement of an amount equal to a height dimension of a coil spring being a deformation amount of 100%.

From the test results of FIG. 21, it can be confirmed that, compared to the first comparative example and the second comparative example, values of tanδ are higher and variations in values of tanδ are smaller with the Example. Thus, from the fact that values of tanδ are higher and variations thereof are smaller, the Example can be said to be a seismic isolation apparatus with higher durability than the first comparative example and the second comparative example.

Anyway, in the embodiments described above, there have been two or three of the coil springs. However, there may be four or more of the coil springs. Furthermore, in the embodiments described above, the twin crystal metallic material has been employed as the material of the wire materials structuring the coil springs. However, different, ordinary metallic materials could be employed as the spring materials.

Further, in the sixth to eighth embodiments described above, because the plural coil springs are mutually coaxially combined and disposed in the outer side laminated body, it is possible to plurally dispose the coil springs with comparatively large spring constants to make maximum possible use of the space. As a result, it is possible to dispose more numerous coil springs in the space of an integral stack. Furthermore, according to alteration of a number of the coil springs that are superposed, spring constants of the coil springs can be added and an apparent spring constant can easily be adjusted to correspond with a required attenuation force.

In the sixth to eighth embodiments described above, the cross-sectional shapes of the wire materials structuring the coil springs have rectangular shapes with long sides of these quadrilaterals in the coil spring radial direction. However, as long as the operations and effects of the present invention are fulfilled, rectangular forms with short sides along the coil spring radial direction are also possible, and square forms are possible too. Furthermore, when the cross-sectional shape of a wire material structuring a coil spring is formed as a quadrilateral, a cross-sectional area of a radially innermost portion, at which it is thought that straining amounts of the coil spring will be largest, is increased relative to a circular cross-section, and strength of the coil spring is improved.

Now, a rigid urethane is employed as the influx material 326 in the sixth to eighth embodiments described above. As this rigid urethane, a product called H-295 (produced by Dia Chemical Co., Ltd.) can be considered, which has characteristics of a JIS-A hardness of 95° and an extensibility of around 370%, and which is formed with an NCO content of 6.0 to 6.4%, a viscosity of 300 to 600 mPa·s (at 75° C.) and a relative density of 1.05 to 1.09 (25/4° C.).

Further, a product called CORONATE 6912 (produced by Nippon Polyurethane Industry Co., Ltd.), which has characteristics of a JIS-A hardness of 990 and an extensibility of around 310%, and which is formed with an NCO content of 7.4 to 7.9% and a viscosity of 320 to 420 mPa·s (at 75° C.), can be considered as an additive to the rigid urethane.

Further yet, the seismic isolation apparatuses relating to the embodiments described above have structures in which the coil springs are constrained from above and below by lid members. However, instead of this, it is possible to employ a structure such that upper and lower ends of the coil springs are fixed at the lid members by the use of fixing fixtures such as screws or the like, to form a structure such that the coil springs more consistently follow displacements of the seismic isolation apparatus.

The apparatus of the first aspect of the present invention may include structure in which the coil spring is formed with a twin crystal metallic material. That is, in this structure, in accordance with the resiliently deformable, helical coil spring being formed of the twin crystal metallic material, pre-straining is applied to the twin crystal metallic material structuring the coil spring. Hence, in comparison with a simple twin crystal alloy, when a tensile force, shearing force or the like is applied, a spring constant is lower and an attenuation coefficient is higher. Thus, the present aspect features large damping characteristics which are equivalent to or better than a conventional damping alloy.

In the apparatus of the first aspect of the present invention, any of Cu—Al—Mn alloys, Mg—Zr alloys, Mn—Cu alloys, Mn—Cu—Ni—Fe alloys, Cu—Al—Ni alloys, Ti—Ni alloys, Al—Zn alloys, Cu—Zn—Al alloys, Mg alloys, Cu—Al—Co alloys, Cu—Al—Mn—Ni alloys, Cu—Al—Mn—Co alloys, Cu—Si alloys, Fe—Mn—Si alloys, Fe—Ni—Co—Ti alloys, Fe—Ni—C alloys, Fe—Cr—Ni—Mn—Si—Co alloys, Ni—Al alloys and SUS304 may be employed as the twin crystal metallic alloy.

That is, when one of these alloys is employed as the twin crystal metallic material for structuring the coil spring, a coil spring featuring damping characteristics equivalent to or better than prior art can be more reliably provided without burdening the environment.

Further, the apparatus of the first aspect of the present invention may include structure in which an inner peripheral face of the outer side laminated body is formed to a shape along a shape of the coil spring. That is, it can be suggested that if the coil spring were simply disposed inside the outer side laminated body, sufficient restraint might not be provided by the inner peripheral face of the outer side laminated body, the coil spring would not properly deform, and a damping effect would be reduced.

In contrast, when continuous indented and protruding forms of the shape along the shape of the coil spring are formed at the inner peripheral face of the outer side laminated body as in the present structure and deformations of the coil spring are optimized, strain is generated in the coil spring effectively without the coil spring being crushed. Here, the inner peripheral face of the outer side laminated body may be formed with a helical structure along the shape of the coil spring.

Further, the apparatus of the first aspect of the present invention may include structure in which fixing fixtures are employed to fix two end portions of the coil spring at two end portions of the outer side laminated body.

That is, the coil spring of the present structure is employed in place of a lead material, but if the coil spring was simply inserted into the outer side laminated body, it can be suggested that, when a large displacement was applied to the seismic isolation apparatus, a large gap would be formed between an end portion of the coil spring and a portion of the seismic isolation apparatus opposing that end portion, as a result of which the coil spring would not be able to follow displacement of the seismic isolation apparatus and hysteresis of a stress-strain curve would not be sufficiently large.

Accordingly, the two end portions of the coil spring are fixed at the two end portions of the outer side laminated body by the fixing fixtures. Hence, the end portions of the coil spring are mechanically limited and the coil spring will follow displacements of the seismic isolation apparatus.

Further, the apparatus of the first aspect of the present invention may include structure in which an outer peripheral face of the inner side laminated body is formed to a shape along an inner peripheral side shape of the coil spring.

That is, if the inner side laminated body were simply disposed inside the coil spring, sufficient restraint might not be provided by the outer peripheral face of the inner side laminated body. Accordingly, when continuous indented and protruding forms of the shape along the shape of the coil spring are formed at the outer peripheral face of the inner side laminated body as in the present structure and deformations of the coil spring are optimized, strain is generated in the coil spring effectively without the coil spring being crushed.

Further, the apparatus of the first aspect of the present invention may include structure in which the coil spring is plurally provided, the plurality of coil springs being coaxially combined and disposed inside the outer side laminated body.

Thus, because the plurality of coil springs are coaxially combined to be disposed, when a large horizontal direction displacement is applied, the individual coil springs are less likely to be crushed and, even after repeated displacements, more stable damping capabilities are exhibited and damping characteristics can be stably preserved.

Further, the apparatus of the second aspect of the present invention may include structure of an inner side laminated body with a form in which inner side resilient plates and inner side stiff plates are alternately laminated, the inner side resilient plates being formed in disc shapes and the inner side stiff plates being formed in disc shapes, and the inner side laminated body being disposed at an inner peripheral side of the coil spring.

That is, in addition to the coil spring made of metal whose wire material cross-sectional shape is a rectangular form, the inner side laminated body is inserted at the inner side of the coil spring to serve as a support material. Thus, the coil spring and the inner side laminated body are incorporated in the outer side laminated body. Hence, when a displacement is inputted to the seismic isolation apparatus of the present structure, the inner side laminated body also limits deformation of the coil spring. Therefore, even when a large horizontal direction displacement is applied, the coil spring will more assuredly not be crushed, stable damping capabilities are exhibited even after repeated displacements, and damping characteristics can be more stably preserved.

As a result, according to the seismic isolation apparatus relating to the present invention, because the inner side laminated body which is formed by laminating the inner side stiff plates and the inner side resilient plates is disposed at the inner peripheral side of the coil spring to serve as the support material, the damping characteristics described above can be provided even without employing a lead material. Therefore, the seismic isolation apparatus is provided with damping characteristics equivalent to or better than a conventional seismic isolation apparatus without burdening the environment.

Further, the apparatus of the second aspect of the present invention may include structure in which the coil spring is plurally provided, the plurality of coil springs being coaxially combined and disposed inside the outer side laminated body.

Thus, because the plurality of coil springs are coaxially combined to be disposed, length of each of the coil springs is shorter. Consequently, an apparent spring constant is raised, and the plurality of coil springs can be disposed in an integrated stack. Therefore, a required attenuating force can easily be set by a number of the superposed coil springs.

Further, the apparatus of the second aspect of the present invention may include structure in which the cross-sectional shape of the wire material structuring the coil spring is a rectangular form with a long side along a radial direction of the coil spring.

Thus, because the cross-sectional shape of the wire material is formed as a rectangular shape in which, in particular, the long sides of the quadrilateral are along the radial direction of the coil spring, neighboring faces of the wire material whose cross-sectional shape is a rectangle more assuredly touch one another. Thus, the wire material limitingly abuts together and a collapse of the coil spring can be more assuredly automatically prevented.

Further, the apparatus of the second aspect of the present invention may include structure in which the wire material structuring the coil spring is formed with a twin crystal metallic material. That is, in this structure, in accordance with the wire material structuring the resiliently deformable, helical coil spring being formed of the twin crystal metallic material, pre-straining is applied to the twin crystal metallic material structuring the coil spring. Hence, in comparison with a simple twin crystal alloy, when a tensile force, shearing force or the like is applied, a spring constant is lower and an attenuation coefficient is higher. Thus, this structure features large damping characteristics equivalent to or better than a conventional damping alloy.

In the apparatus of the second aspect of the present invention, any of Cu—Al—Mn alloys, Mg—Zr alloys, Mn—Cu alloys, Mn—Cu—Ni—Fe alloys, Cu—Al—Ni alloys, Ti—Ni alloys, Al—Zn alloys, Cu—Zn—Al alloys, Mg alloys, Cu—Al—Co alloys, Cu—Al—Mn—Ni alloys, Cu—Al—Mn—Co alloys, Cu—Si alloys, Fe—Mn—Si alloys, Fe—Ni—Co—Ti alloys, Fe—Ni—C alloys, Fe—Cr—Ni—Mn—Si—Co alloys, Ni—Al alloys and SUS304 may be employed as the twin crystal metallic alloy.

That is, when one of these alloys is employed as the twin crystal metallic material for forming the wire material that structures the coil spring, a coil spring featuring damping characteristics equivalent to or better than prior art can be more reliably provided without burdening the environment.

Further, the apparatus of the third aspect of the present invention may include structure in which a rigid urethane is employed as the influx material. That is, in the present structure, of synthetic resin materials, the influx material is formed of a rigid urethane with large extension amounts, which has a comparatively high elastic coefficient but is hard. Hence, restraining force on the coil springs is raised and crushing of the coil springs can be more reliably prevented, even when displacement amounts are large.

Further, the apparatus of the third aspect of the present invention may include structure in which an inner peripheral face of the outer side laminated body is formed in an indented and protruding form to correspond with a shape of an outer peripheral face side of the plurality of coil springs. That is, in the present aspect, because the inner periphery face of the outer side laminated body is formed in the indented/protruding form to correspond with the shape of the outer peripheral side face of the coil springs, the inner periphery face of the outer side laminated body meshes with the outer peripheral side of the coil springs. As a result, movements of the coil springs are also limited by the inner periphery face of the outer side laminated body, and crushing of the coil springs can be prevented.

Further, the apparatus of the third aspect of the present invention may include structure in which the plurality of coil springs are coaxially combined and disposed inside the outer side laminated body. Thus, because the plurality of coil springs are mutually coaxially combined and disposed in the outer side laminated body, even if there is little space inside the outer side peripheral body, it is possible to plurally dispose coil springs with comparatively large spring constants to make maximum possible use of the space. As a result, it is possible to dispose a greater number of coil springs in the space of an integral stack.

Hence, because the plurality of coil springs are coaxially combined and disposed, the length of each coil spring is shorter, and accordingly the spring constants of the coil springs are higher. Furthermore, by variation of a number of the coil springs that are superposed, spring constants of the coil springs can be added together and an apparent spring constant can easily be adjusted to correspond to a required attenuation force.

Further, the apparatus of the third aspect of the present invention may include structure in which the cross-sectional shape of the wire material structuring each coil spring is a rectangular form with a long side along a radial direction of the coil springs.

Thus, because the cross-sectional shapes of the wire materials are formed as rectangular shapes in which, in particular, long sides of the quadrilaterals are along the radial direction of the coil springs, neighboring faces of the wire materials whose cross-sectional shapes are rectangles more assuredly touch one another. Thus, the wire materials of the plurality of coil springs limitingly abut together and a collapse of the coil springs can be more assuredly automatically prevented.

Further, the apparatus of the third aspect of the present invention may include structure in which the wire material structuring each coil spring is formed with a twin crystal metallic material. That is, with such a structure, in accordance with the wire materials structuring the resiliently deformable, helical coil springs being formed of the twin crystal metallic material, pre-straining is applied to the twin crystal metallic materials structuring the coil springs. Hence, in comparison with a simple twin crystal alloy, when a tensile force, shearing force or the like is applied, a spring constant is lower and an attenuation coefficient is higher. Thus, this structure features large damping characteristics equivalent to or better than a conventional damping alloy.

In the apparatus of the third aspect of the present invention, any of Cu—Al—Mn alloys, Mg—Zr alloys, Mn—Cu alloys, Mn—Cu—Ni—Fe alloys, Cu—Al—Ni alloys, Ti—Ni alloys, Al—Zn alloys, Cu—Zn—Al alloys, Mg alloys, Cu—Al—Co alloys, Cu—Al—Mn—Ni alloys, Cu—Al—Mn—Co alloys, Cu—Si alloys, Fe—Mn—Si alloys, Fe—Ni—Co—Ti alloys, Fe—Ni—C alloys, Fe—Cr—Ni—Mn—Si—Co alloys, Ni—Al alloys and SUS304 may be employed as the twin crystal metallic alloy.

That is, when one of these alloys is employed as the twin crystal metallic material for forming the wire materials that structure the coil springs, coil springs featuring damping characteristics equivalent to or better than prior art can be more reliably provided without burdening the environment.

According to the above-described structures of the present invention as explained hereabove, there is an excellent effect in that it is possible to provide a seismic isolation apparatus which features damping characteristics equivalent to or better than prior art without imposing a burden on the environment.

What is claimed is:

1. A seismic isolation apparatus comprising:

an outer side laminated body with a form in which first resilient plates and first stiff plates are alternately laminated, the first resilient plates being formed in ring shapes and the first stiff plates being formed in ring shapes;

a coil spring fabricated of metal, which is disposed inside the outer side laminated body; and an inner side laminated body, with a form in which second resilient plates and second stiff plates are alternately laminated, the second resilient plates being formed in disc shapes and the second stiff plates being formed in disc shapes, and the inner side laminated body being disposed at an inner peripheral side of the coil spring, wherein the coil spring is formed with a twin crystal metallic material.

2. A seismic isolation apparatus comprising:

an outer side laminated body with a form in which first resilient plates and first stiff plates are alternately laminated, the first resilient plates being formed in ring shapes and the first stiff plates being formed in ring shapes;

a coil spring fabricated of metal, which is disposed inside the outer side laminated body; and an inner side laminated body, with a form in which second resilient plates and second stiff plates are alternately laminated, the second resilient plates being formed in disc shapes and the second stiff plates being formed in disc shapes, and the inner side laminated body being disposed at an inner peripheral side of the coil spring, wherein the coil spring is formed with a twin crystal metallic material, and wherein at least one alloy selected from Cu—Al—Mn alloys, Mg—Zr alloys, Mn—Cu alloys, Mn—Cu—Ni—Fe alloys, Cu—Al—Ni alloys, Ti—Ni alloys, Al—Zn alloys, Cu—Zn—Al alloys, Mg alloys, Cu—Al—Co alloys, Cu—Al—Mn—Ni alloys, Cu—Al—Mn—Co alloys, Cu—Si alloys, Fe—Mn—Si alloys, Fe—Ni—Co—Ti alloys, Fe—Ni—C alloys, Fe—Cr—Ni—Mn—Si—Co alloys, Ni—Al alloys or SUS304 is employed as the twin crystal metallic alloy.

3. A seismic isolation apparatus comprising:

an outer side laminated body with a form in which outer side resilient plates and outer side stiff plates are alternately laminated, the outer side resilient plates being formed in ring shapes and the outer side stiff plates being formed in ring shapes; and a coil spring fabricated of metal, which is disposed inside the outer side laminated body, a cross-sectional shape of a wire material of the coil spring being a quadrilateral form, wherein the wire material structuring the coil spring is formed with a twin crystal metallic material.

4. The seismic isolation apparatus of claim 3, wherein at least one alloy selected from Cu—Al—Mn alloys, Mg—Zr alloys, Mn—Cu alloys, Mn—Cu—Ni—Fe alloys, Cu—Al—Ni alloys, Ti—Ni alloys, Al—Zn alloys, Cu—Zn—Al alloys, Mg alloys, Cu—Al—Co alloys, Cu—Al—Mn—Ni alloys, Cu—Al—Mn—Co alloys, Cu—Si alloys, Fe—Mn—Si alloys, Fe—Ni—Co—Ti alloys, Fe—Ni—C alloys, Fe—Cr—Ni—Mn—Si—Co alloys, Ni—Al alloys or SUS304 is employed as the twin crystal metallic alloy.

5. A seismic isolation apparatus comprising:

an outer side laminated body with a form in which outer side resilient plates and outer side stiff plates are alternately laminated, the outer side resilient plates being formed in ring shapes and the outer side stiff plates being formed in ring shapes;

a plurality of coil springs fabricated of metal, which are disposed inside the outer side laminated body, cross-sectional shapes of wire materials of the coil springs being quadrilaterals, and external diameters of the coil springs being mutually different; and an influx material which is influxed to inside the outer side laminated body and is capable of restricting movement of the coil springs, wherein the wire material structuring each coil spring is formed with a twin crystal metallic material.

6. A seismic isolation apparatus comprising:

an outer side laminated body with a form in which outer side resilient plates and outer side stiff plates are alternately laminated, the outer side resilient plates being formed in ring shapes and the outer side stiff plates being formed in ring shapes;

a plurality of coil springs fabricated of metal, which are disposed inside the outer side laminated body, cross-sectional shapes of wire materials of the coil springs being quadrilaterals, and external diameters of the coil springs being mutually different; and an influx material which is influxed to inside the outer side laminated body and is capable of restricting movement of the coil springs, wherein the wire material structuring each coil spring is formed with a twin crystal metallic material, and wherein at least one alloy selected from Cu—Al—Mn alloys, Mg—Zr alloys, Mn—Cu alloys, Mn—Cu—Ni—Fe alloys, Cu—Al—Ni alloys, Ti—Ni alloys, Al—Zn alloys, Cu—Zn—Al alloys, Mg alloys, Cu—Al—Co alloys, Cu—Al—Mn—Ni alloys, Cu—Al—Mn—Co alloys, Cu—Si alloys, Fe—Mn—Si alloys, Fe—Ni—Co—Ti alloys, Fe—Ni—C alloys, Fe—Cr—Ni—Mn—Si—Co alloys, Ni—Al alloys or SUS304 is employed as the twin crystal metallic alloy.

* * * * *